US006967292B2

(12) United States Patent
Nishimura

(10) Patent No.: US 6,967,292 B2
(45) Date of Patent: Nov. 22, 2005

(54) KEY SHEET

(75) Inventor: Takeshi Nishimura, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 0 days.

(21) Appl. No.: 10/861,444

(22) Filed: Jun. 7, 2004

(65) Prior Publication Data

US 2005/0000788 A1 Jan. 6, 2005

(30) Foreign Application Priority Data

Jun. 3, 2003 (JP) ..... 2003-158356

(51) Int. Cl.[7] ..... H01H 6/26
(52) U.S. Cl. ..... 200/5 A; 200/5 R
(58) Field of Search ..... 200/310–314, 200/512–520, 341, 5 A, 5 R

(56) References Cited

U.S. PATENT DOCUMENTS 5,661,279 A * 8/1997 Kenmochi ..... 200/314
6,734,382 B2 * 5/2004 Arai et al. ..... 200/512

FOREIGN PATENT DOCUMENTS

EP 1 467 391 A1 * 10/2004
JP 04329228 * 11/1992
JP 2004111258 * 4/2004
JP 2004221000 * 8/2004
JP 2004319396 * 11/2004
JP 2004327417 * 11/2004
JP 2004327420 * 11/2004
JP 1 484 778 A2 * 12/2004

* cited by examiner

*Primary Examiner*—Elvin G. Enad
*Assistant Examiner*—Lisa Klaus
(74) *Attorney, Agent, or Firm*—Rader, Fishman & Grauer PLLC

(57) ABSTRACT

A key sheet is equipped with a keytop exposed through an operational opening with no partition frame formed in the casing of an apparatus, the keytop being adapted to be depressed into the casing, and a base sheet to which the keytop is firmly attached, in which it is possible to achieve a further reduction in the thickness of the base sheet. In this key sheet, the base sheet is equipped with a pedestal portion to which the keytop is firmly attached and a frame-like support portion supporting the pedestal portion so as to allow its displacement, wherein a clearance portion allowing the keytop to avoid press contact with the frame-like support portion at the time of depressing operation is formed in the outer edge side portion of the bottom portion of the keytop opposed to the frame-like support portion, whereby even if the pedestal portion is thin, it is possible to perform depressing operation on the keytop without any fear of the keytop being caught by the frame-like support portion.

10 Claims, 25 Drawing Sheets

111
112
103b
103c
103c
113
113
113

KEY SHEET

BACKGROUND OF THE INVENTION

1. Field of the Invention

The present invention relates to a key sheet for a pushbutton switch for use in the operating portion of an apparatus, such as a mobile phone, a PDA, a car navigation apparatus, or a car audio apparatus, and more specifically, to a key sheet suitable for a case in which a plurality of keytops are exposed for use through an operational opening of a casing having no partition frame for separating from each other the plurality of keytops exposed from the casing of an apparatus.

2. Description of the Related Art

For example, a pushbutton switch is known in which, as in the case of a mobile phone 101 shown in FIG. 18, due to requirements in terms of miniaturization, artistic design property, etc. of the operating portion, a plurality of keytops 103 of a key sheet 102 that are arranged close to each other are exposed through an operational opening 101*b* with no partition frame formed in a casing 101*a*. As shown in FIG. 19, this key sheet 102 equipped with the keytops 103 consists of a base sheet 104 formed of silicone rubber to which a plurality of (seventeen in total in this case) keytops 103 are firmly attached. Specifically, this key sheet is composed of a large keytop 103*a* situated in the upper middle portion thereof and used for directional inputs in the vertical and horizontal directions, four small keytops 103*b* situated on the right-hand and left-hand sides thereof, and twelve medium-sized keytops 103*c* situated below them. The gaps between the adjacent keytops 103*a*, 103*b*, and 103*c* are very narrow, the keytops being arranged at a pitch, for example, of as small as approximately 0.15 mm to 0.2 mm. The gap between the keytops and the operational opening 101*b* is also very narrow, its dimension being approximately the same as mentioned above.

As shown in FIG. 20, this key sheet 102 is mounted to the mobile phone 101, with the base sheet 104 being sandwiched between and in press contact with the back surface of the casing 101*a* and a circuit board 101*d*. Usually, the base sheet 104 is formed of soft silicone rubber, so that when, for example, as shown in FIG. 21, during use of the mobile phone 101, it is set upright or when, as shown in FIG. 22, it is laid face down, the base sheet 104 may expand in its entirety under the weight of the keytops 103 to be thereby distorted. This may lead to positional deviation between pushers 104*a* of the base sheet 104 and contact switches 101*e* provided on the circuit board 101*d*, which is composed of metal disc springs and a contact circuit, resulting in a malfunction, making it impossible to effect input even when the keytops 103 are depressed.

To eliminate this problem, the present applicant has proposed a key sheet 111 as shown in FIG. 23 (JP 2003-114833 A). This key sheet 111 has a base sheet 112 equipped with a thin, hard resin plate 113. Further, the hard resin plate 113 has, at the positions where the keytops 103 are to be provided, rectangular through-holes 114 formed by lattice-like frame portions 113*a*, and pedestal portions 115 formed of a rubber-like elastic material and formed so as to close the through-holes 114. In this key sheet 111, the frame portions 113*a* of the hard resin plate 113 serve as frame-like support portions effecting floating support of the pedestal portions 115 so as to allow their displacement, so that it is possible to restrain generation of an overall distortion of the base sheet 104 as shown in FIG. 21 or 22.

Incidentally, it is often desirable for the mobile phone 101, whose casing 101*a* has no partition frame, to be of a thin type. That is, in the mounting structure as shown in FIG. 24, in which the key sheet 111 is mounted to the casing 101*a*, there is a demand for a further reduction in a distance d1 between the circuit board 101*d* and the casing 101*a*. If, to meet this demand, the pedestal portions 115 are made thinner to be flush with the surface of the base sheet 112, as shown, for example, in FIG. 25, the keytops 103 will be caught by the hard resin plate 113, making it impossible to fully depress the keytops 103 so as to reliably effect contact input.

SUMMARY OF THE INVENTION

The present invention has been made with a view toward solving the above problem. It is an object of the present invention to provide a key sheet which allows a further reduction in the thickness of the base sheet 112 to achieve a reduction in the thickness of the apparatus even in a case in which there is used the key sheet 111 equipped with the base sheet 112 partially having a hard member as in the case of a pushbutton switch in which the keytops 103 arranged close to each other are exposed through the operational opening 101*b* with no partition frame.

To attain the above object, according to the present invention, there is provided a key sheet including a keytop exposed through an operational opening with no partition frame formed in a casing of an apparatus, the keytop being adapted to be depressed into the casing, and a base sheet to which the keytop is firmly attached, wherein the base sheet is equipped with a pedestal portion to which the keytop is firmly attached and a frame-like support portion supporting the pedestal portion so as to allow displacement of the pedestal portion, and wherein a clearance portion allowing the keytop to avoid press contact with the frame-like support portion at a time of depressing operation is formed in an outer edge side portion of a bottom portion of the keytop opposed to the frame-like support portion.

In accordance with the present invention, the base sheet is equipped with the pedestal portion to which the keytop is firmly attached and the frame-like support portion supporting the pedestal portion so as to allow displacement thereof, and the clearance portion for avoiding press contact with the frame-like support portion at the time of depressing operation is formed in the outer edge side portion of the keytop bottom portion, so that even when the keytop is so large as to cover the pedestal portion, there is no fear of the keytop being caught by the frame-like support portion when the keytop is depressed. Thus, by making the pedestal portion thinner, it is possible to reduce the thickness of the key sheet, and it is possible to obtain a key sheet providing an appropriate depression stroke corresponding to the amount by which the keytop moves when depressed. Further, the present invention is applicable not only to a single pushbutton switch, but also to a plurality of pushbutton switches equipped with a plurality of pedestal portions and frame-like support portions respectively corresponding to the pedestal portions.

It is to be noted that the clearance portion in the outer edge side portion of the keytop bottom portion is not necessarily required to have a "depth" completely preventing contact with the frame-like support portion at the time of depressing operation. It is only necessary that contact input be effected through depression of the keytop. In this sense, the clearance portion may even have a "depth" allowing contact with the frame-like support portion at the time of depressing operation. Further, to effect contact input through keytop depressing operation with light touch, it is desirable to provide a clearance portion which causes the end of the frame-like support portion and the end of the keytop bottom portion to be spaced apart from each other by approximately 0.5 mm or more.

In a more specific embodiment of the present invention, the frame-like support portion can be formed by a reinforcing member formed of a hard resin thin plate supporting the pedestal portion. Since the frame-like support portion consists of a reinforcing member formed by a hard resin thin plate supporting the pedestal portion, the pedestal portion is supported by hard resin, whereby the rigidity of the base sheet is enhanced, and even if the key sheet is erected or laid-down during use of the portable apparatus, such as a mobile phone or a PDA, generation of an overall distortion of the key sheet is restrained. Thus, it is possible to mitigate, as much as possible, operational malfunction due to positional deviation between the keytops and the contact switches, a deterioration in operability due to a difference in depression stroke amount between the keytops, and adverse influences on the artistic design property of the apparatus. Further, this reinforcing member may consist of a single plate having through-holes for firmly attaching each pedestal portion through bridging. By forming the reinforcing member as a single plate, it is possible to achieve an improvement in overall rigidity, thereby making it possible to reliably restrain generation of an overall distortion of the key sheet.

Further, in a specific embodiment of the present invention, the frame-like support portion may be formed by a resin film having a through-hole for firmly attaching the pedestal portion through bridging. When the frame-like support portion is formed by such a resin film as well, the resin film is reinforced by the pedestal portion due to a structure in which the through-hole of the resin film is filled with the pedestal portion, whereby the overall rigidity of the key sheet is enhanced.

Further, in the present invention, when the resin film is equipped with a reinforcing member of hard resin for regulating distortion of the base sheet, it is possible to reliably restrain the generation of distortion. As a specific example of such a reinforcing member, it is possible to adopt a resin molding body glued to the resin film. In this case, the resin molding body may be a single molding body or a plurality of molding bodies of the same or different materials. Further, it is also possible to form through molding a resin molding body integrated with the resin film. In this case, the molding method used may, for example, be insert molding or an in-mold molding. Further, it is also possible to adopt a cured body of liquid resin applied to the resin film. In this case, the liquid resin may be a reaction curing resin, such as a thermosetting resin, a photo setting resin, a humidity setting resin, or a pressure/humidity setting resin, or a non-reaction curing resin, such as a thermoplastic resin.

In the present invention, the pedestal portion may consist of a rubber-like elastic body. Since a clearance portion for avoiding press contact with the frame-like support portion at the time of depressing operation is formed in the outer edge side portion of the keytop bottom portion opposed to the frame-like support portion, the pedestal portion can be depressed without allowing the keytop to be caught by the frame-like support portion when the keytop is depressed. When the pedestal portion, which is formed of a rubber-like elastic material, is depressed, it undergoes elastic deformation, and a predetermined depression stroke can be achieved. Thus, there is no fear of the keytop not allowing depression.

Further, in the present invention, it is possible to realize a key sheet in which the keytop fixation side surface of the base sheet is flat. Since the key sheet uses a base sheet whose keytop fixation side surface is flat, the thickness of the key sheet may be small. It is to be noted that the present invention does not exclude the possibility of a key sheet construction in which the surface of the base sheet fixed to the keytop protrudes toward the surface of the base sheet to which the keytop is not fixed. Even in the case in which the surface fixed to the keytop is convex toward the surface not fixed to the keytop, if the protruding amount is small, the keytop is likely to be caught by the frame-like support portion in the conventional keytop configuration. In the present invention, however, the keytop is equipped with a clearance portion, so that it is possible to avoid press contact with the frame-like support portion.

The key sheet of the present invention can be small in thickness, making it possible to reduce the thickness of the apparatus or the like to which this key sheet is mounted. In particular, even when a key sheet containing a relatively hard material such as hard resin is used as in the case of a pushbutton switch in which keytops arranged close to each other are exposed through an operational opening with no partition frame, it is possible to realize a base sheet whose surface fixed to the keytops is flat, thus providing a thin key sheet allowing achievement of a predetermined depression stroke.

Further, in the key sheet of the present invention, the rigidity of the base sheet is improved, and even when it is erected or laid-down, it is possible to restrain distortion of the key sheet, so that, even in an erect or laid-down state, it is possible to reliably perform an input operation on the apparatus, and there is no fear of the artistic design property of the apparatus being impaired.

The above description of the present invention should not be construed restrictively. The objects, advantages, features, and uses of the present invention will be further clarified through the following description with reference to the accompanying drawings. Further, it is to be understood that all appropriate modifications not departing from the gist of the present invention are to be covered by the scope of the present invention.

BRIEF DESCRIPTION OF THE DRAWINGS

In the accompanying drawings.

DESCRIPTION OF THE PREFERRED EMBODIMENTS

Figure 1:
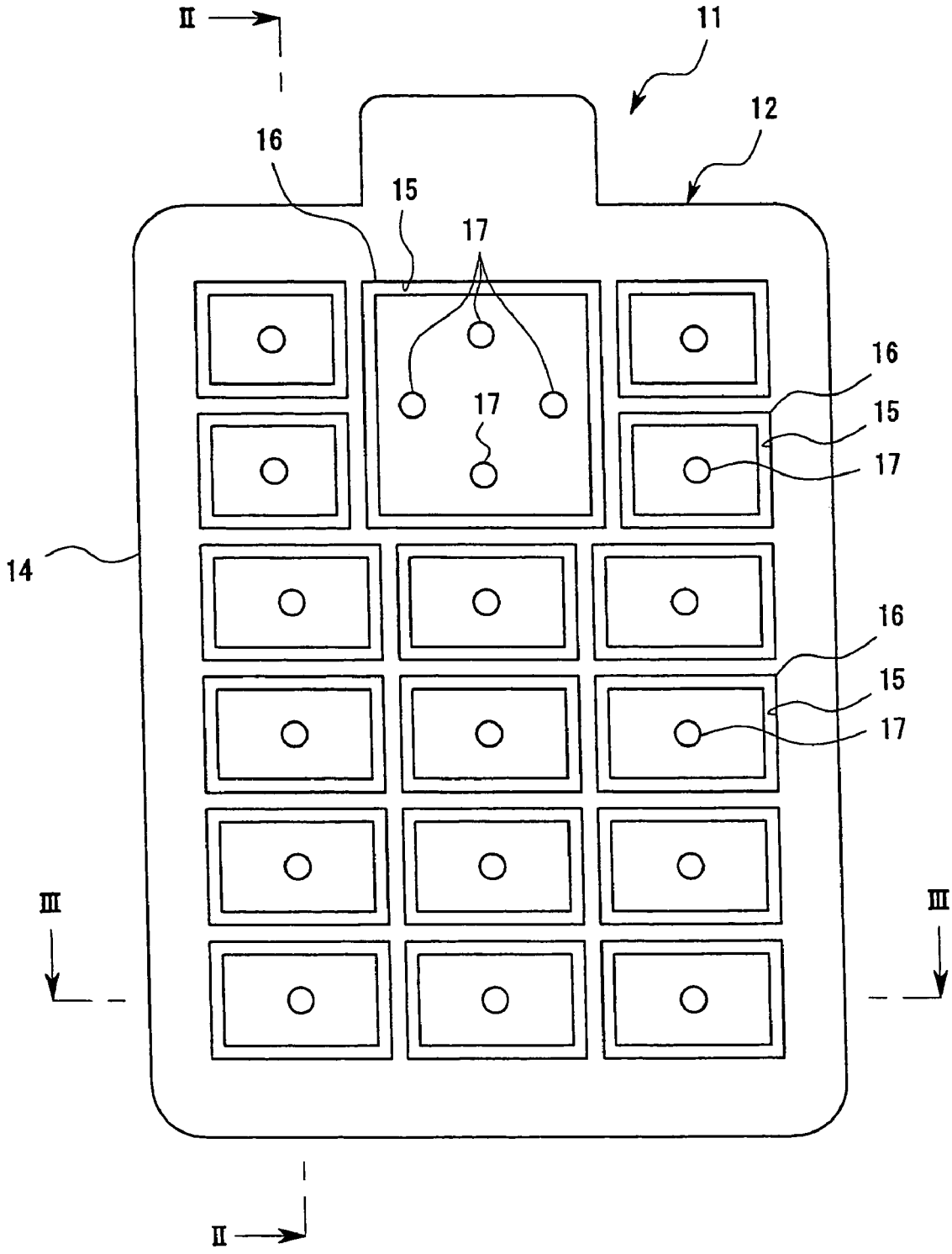
FIG. 1 is an top plan view of the back surface of a key sheet according to a first embodiment of the present invention.

In the following, embodiments of the present invention will be described with reference to the drawings. The components common to those of the above-described conventional example and the components common to the embodiments of the present invention are indicated by the same reference numerals, and a description of such components will be omitted. In the following description, a mobile phone 101 is adopted as an example of the various apparatuses to which the present invention is applicable, and a key sheet for a pushbutton switch applicable thereto will be described.

Figure 2:
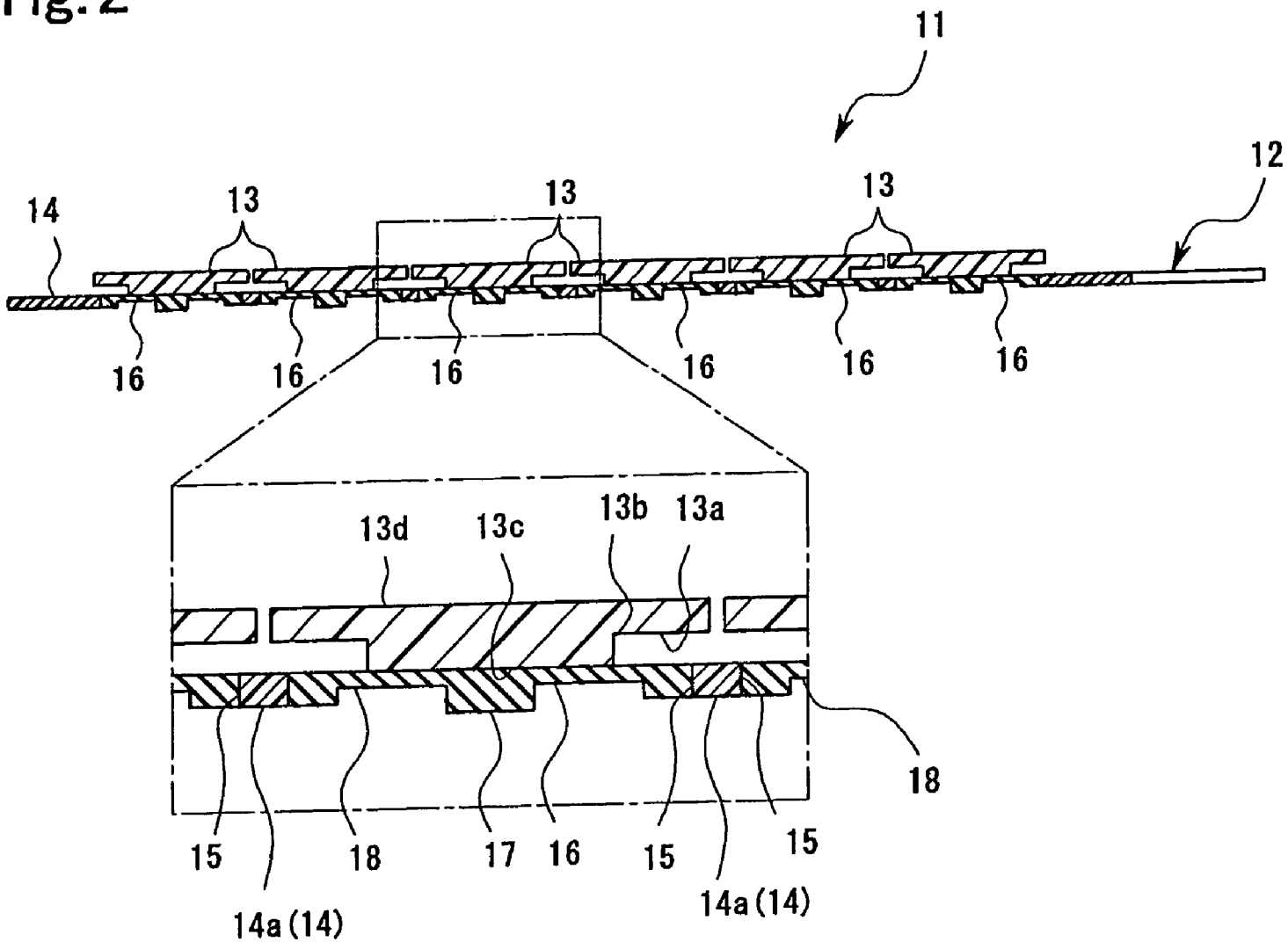
FIG. 2 is a sectional view taken along the line II—II of FIG. 1.
Figure 3:
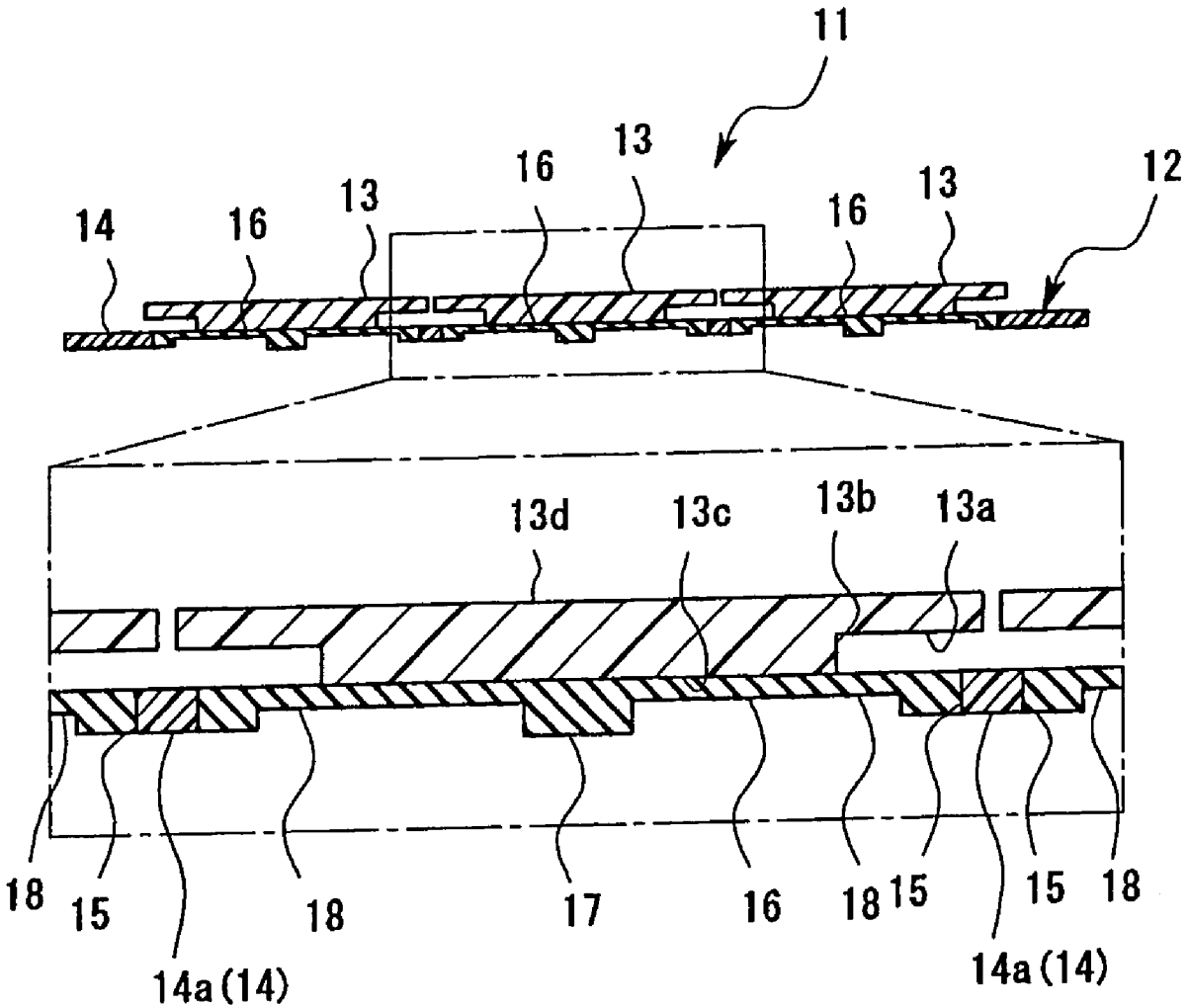
FIG. 3 is a sectional view taken along the line III—III of FIG. 1.

First Embodiment Shown in FIGS. 1 through 5;

FIG. 1 is an outward view of the back surface of a key sheet 11 according to a first embodiment of the present invention. FIGS. 2 and 3 are sectional views respectively taken along the lines II—II and III—III of FIG. 1. As shown in these drawings, the key sheet 11 of this embodiment is composed of a base sheet 12 and keytops 13 firmly attached to the base sheet 12. The base sheet 12 is equipped with a hard resin plate 14 serving as a reinforcing member comprising a single, rectangular plate with rounded corners having a rectangular tongue portion at the top. The hard resin plate 14 has, in the portions where the keytops 13 are provided, rectangular through-holes 15 formed by lattice-like frame portions 14*a*. The through-holes 15 are closed by pedestal portions 16 formed of a rubber-like elastic material. The pedestal portions 16 have on the bottom surfaces thereof downwardly protruding columnar pushers 17, and have the keytops 13 on the upper surfaces thereof. Further, in the portions of the pedestal portions 16 outside their surfaces fixed to the keytops 13, there are formed thin-walled flexible portions 18. And, the frame portions 14*a* of the hard resin plate 14 constitute a frame-like support portion supporting the pedestal portions 16.

Figure 4A:
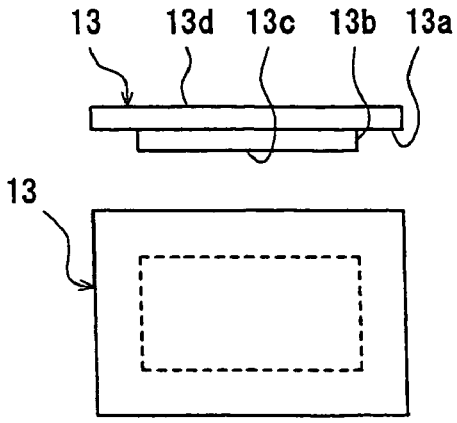
FIGS. 4A through 4F are front elevational views and plan views of keytops of various configurations.
Figure 4B:
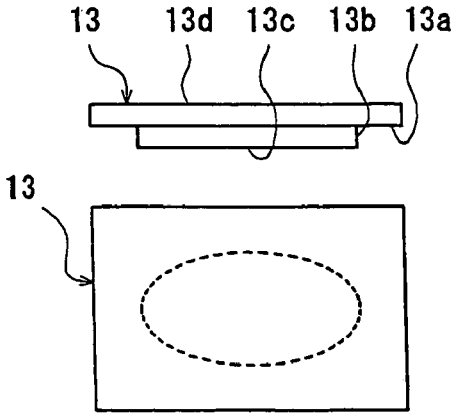
Figure 4C:
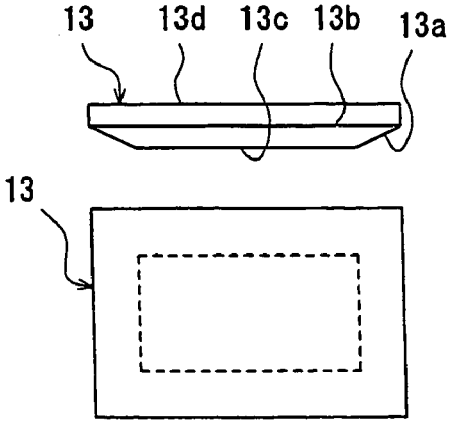
Figure 4D:
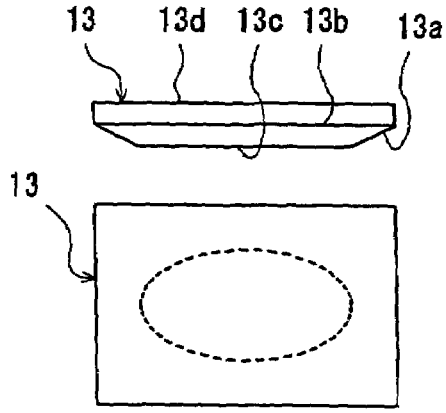
Figure 4E:
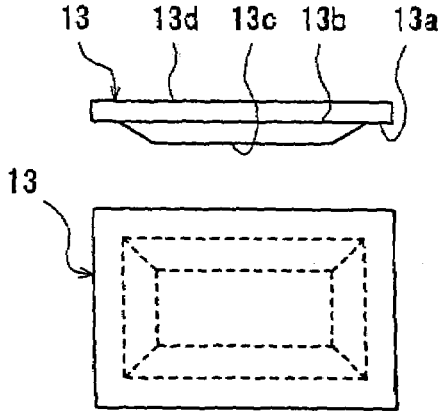
Figure 4F:
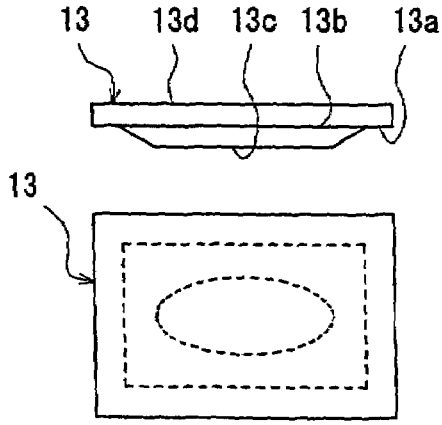

Each keytop 13 has a clearance portion 13*a* over the entire periphery of the outer edge side portion of its bottom portion. On the inner side of the clearance portion 13*a*, there exists a protrusion 13*b* protruding downwardly. The protrusion 13*b* has at its lower end a fixation surface 13*c* firmly attached to the pedestal portion 16 of the base sheet 12 by adhesive or the like. Thus, the fixation surface 13*c* of the keytop 13 firmly attached to the base sheet 12 has an area smaller than the top surface 13*d* of the keytop 13; even if the keytop top surface 13*d* is so large as to cover the pedestal portion 16 and, further, overlap the frame portion 14*a* of the hard resin plate 14, the fixation surface 13*c* of the keytop 13 is within the surface of the pedestal portion 16, and does not reach the hard resin plate 14. FIG. 4A depicts front and plan views of the configuration of the keytop 13 shown in FIGS. 1 through 3; the configuration of the keytop 13 is not restricted thereto and allows modifications as appropriate. For example, it is also possible to adopt the configurations as shown in FIGS. 4B through 4F. That is, if the top surface 13*d* of the keytop 13 is large enough to cover the pedestal portion 16, there is no problem when there is provided the clearance portion 13*a* in the outer edge side portion of the bottom portion of the keytop 13 opposed to the frame portion 14*a*, thereby avoiding press contact with the frame portion 14*a* serving as the frame-like support portion during depressing operation of the keytop 13; however, from the viewpoint of the machinability of the keytop 13 and the operational reliability thereof, it is desirable to adopt the configurations as shown in FIGS. 4A and 4B, in which the outer edge side portion of the bottom portion of the keytop 13 is cut at right angles with respect to the fixation surface 13*c* to thereby provide the protrusion 13*b*. However, in the case of a so-called illumination type key sheet, in which light is emitted from an inner light source to illuminate the keytop 13, it is also desirable to adopt the configurations as shown in FIGS. 4C and 4D, in which light from within is evenly transmitted with ease. Further, in a case in which the fixation surface of the pedestal portion 16 fixed to the keytop 13 has a small area, it is also desirable to adopt the configurations as shown in FIGS. 4E and 4F. The keytop 13 may be equipped with a display layer formed of ink, plating or the like and indicating a character, number, symbol or the like.

The base sheet 12 has a hard resin plate 14 as its base, and the pedestal portions 16 supporting the keytops 13 are formed in the through-holes 15 thereof. And, the surface of the base sheet 12 on the side of the fixation surfaces 13*c* of the keytops 13 is formed as a flat surface. In this base sheet 12, even when the key sheet 11 is erected or laid down to bear the weight of the keytops 13 on the hard resin plate 14, overall distortion of the key sheet 11 is restrained due to the rigidity of the hard resin plate 14. Thus, there is no fear of operational malfunction due to positional deviation between the pushers 17 and the contact switches 101*e* of the circuit board 101*d* or a deterioration in operational feel due to a difference in depression stroke or, further, a deterioration in the artistic design property of the mobile phone 101.

Figure 5:
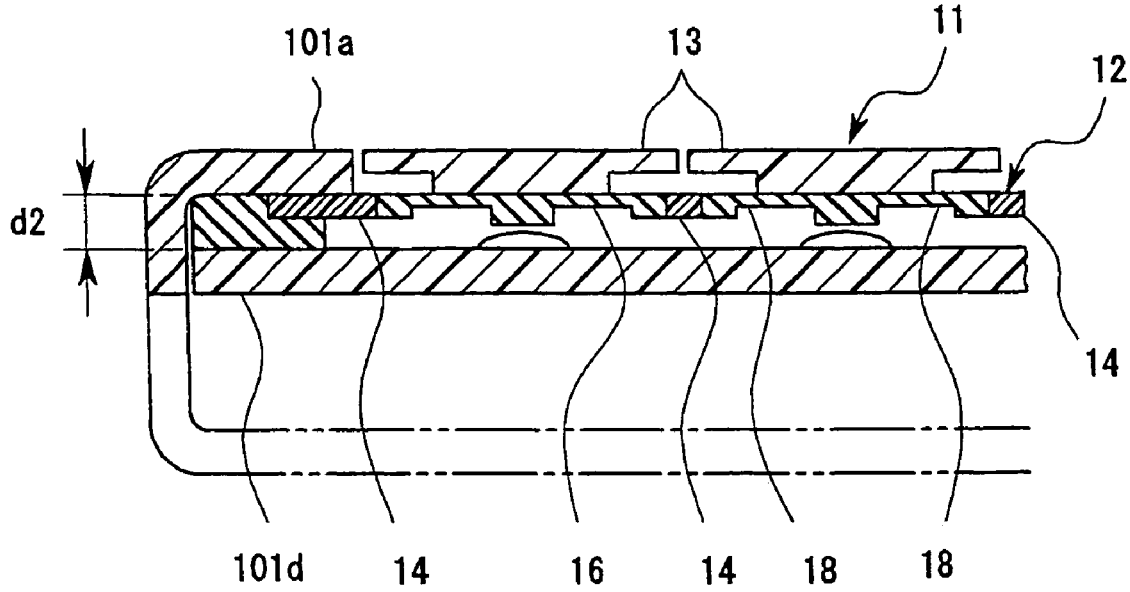
FIG. 5 is a schematic sectional view of the key sheet of the first embodiment of the present invention as attached to a mobile phone.
Figure 24:
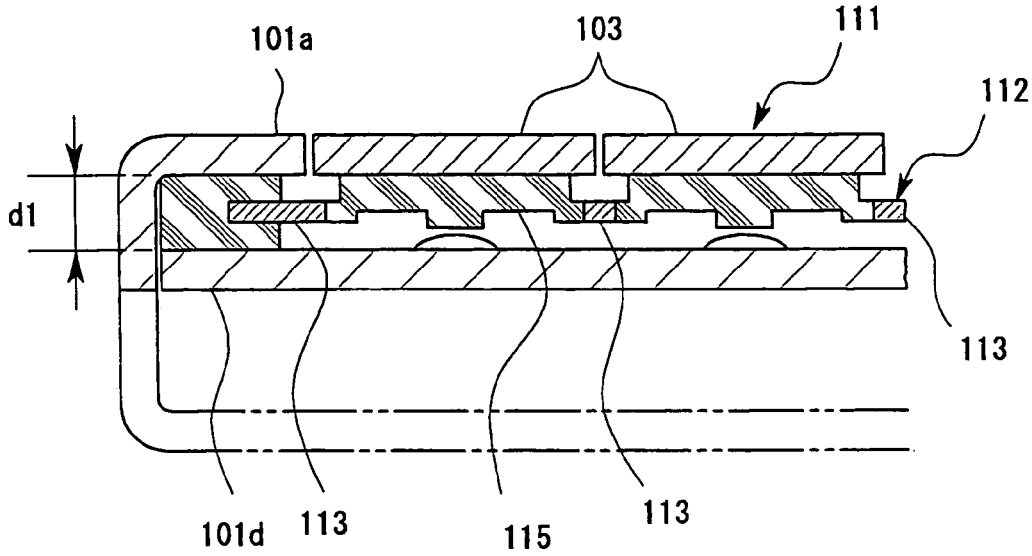
Fig.24 Related Art
FIG. 24 is a schematic sectional view of the conventional key sheet of FIG. 23 as attached to a mobile phone.
Figure 25:
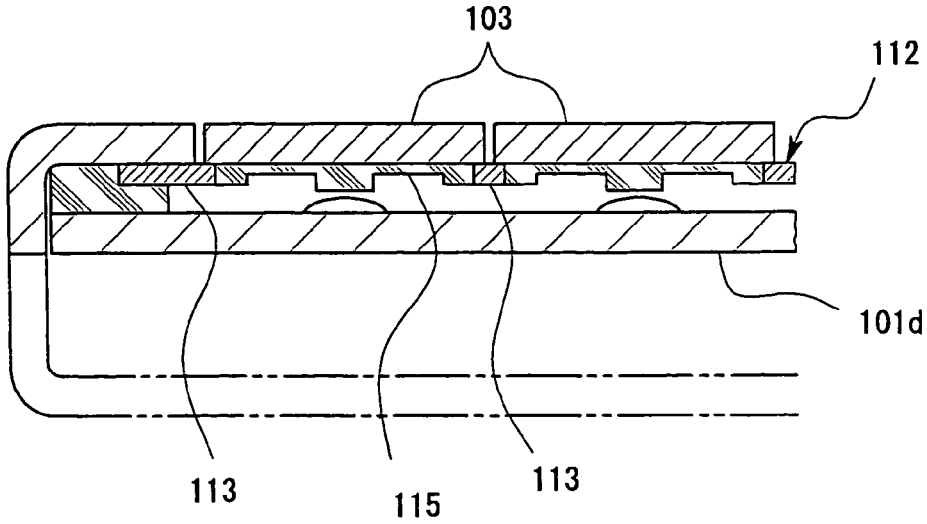
Fig.25 Related Art
FIG. 25 is a schematic sectional view of a conventional key sheet with keytops fixed thereto by using a thin base sheet in a state in which it is attached to a mobile phone.

Due to the construction of each keytop 13, in which there is provided the clearance portion 13*a* over the entire periphery of the outer edge side portion on the bottom surface of the keytop 13, that is, on the fixation surface side fixed to the pedestal portion 16, it is possible to reduce the thickness of the key sheet 11. That is, in the conventional key sheet 111 as shown in FIG. 24, the distance between the casing 101*a* and the circuit board 101*d* is d1, whereas, in the key sheet 11 of the present invention, the distance between the casing 101*a* and the circuit board 101*d* is d2, which is smaller than d1, as shown in FIG. 5; despite this reduction in thickness, the keytop 13 can be depressed without being caught by the hard resin plate 14, and the pushbutton function is not impaired. Thus, it is possible to reduce the thickness of an apparatus, such as the mobile phone 101, and to obtain an appropriate depression stroke, making it possible to perform the same input operation as in the case of the conventional key sheet. However, to make it possible to effect input with light touch, it is desirable for the distance between the end of the hard resin plate 14 and the end of the protrusion 13*b* of the keytop 13 to be not less than 0.5 mm although this depends on the thickness, configuration, and elastic modulus of the key sheet 11, the distance between the pushers 17 and the contact switches 101*e*, etc.

Further, each pedestal portion 16 has, on the outer side of the fixation surface thereof firmly attached to the keytop 13, a thin-walled flexible portion 18 floatingly supporting the keytop 13 so as to allow displacement through depression, so that, when the keytop 13 is depressed, the depression load is applied to the flexible portion 18, and the flexible portion 18 is easily deformed, thus, making it possible to perform depressing operation on the keytop 13 with light touch.

Next, the materials of the portions forming the key sheet 11 will be described.

Usually, a thermoplastic resin or a thermosetting resin is used as the material for the keytops 13. However, it is also possible to employ a rubber-like elastic material, such as silicon rubber or thermoplastic elastomer. Further, since the rigidity of the base sheet 12 is high, it is also possible to use a metal material that is relatively heavy.

As the hard resin plate 14, one with high rigidity is suitable from the viewpoint of restraining distortion of the key sheet 11. Examples of such material for the hard resin plate 14 include a polycarbonate resin, a polymethyl methacrylate resin, a polypropylene resin, polystyrene-based resins, polyacrylic-based copolymer resins, polyolefin-based resins, a acrylonitrile butadiene styrene resin, polyester-based resins, epoxy-based resins, polyurethane-based resins, a polyamide resin, and silicone-based resins.

As for the material of the pedestal portions 16, it is possible to use, apart from silicone rubber, thermoplastic elastomers such as styrene-based, ester-based, urethane-based, olefin-based, amide-based, butadiene-based, ethylene-vinyl-acetate-based, vinyl chloride-based, fluoro rubber-based, isoprene-based, and chlorinated polyethylene-based elastomers. Then, the respective materials may be selected in accordance with the fixation method, fixation force, requisite characteristics of the hard resin plate 14 and the pedestal portions 16. Further, it is desirable for the hardness of the materials to range from type A40 to A80 as defined in JIS K6253. When the hardness is lower than type A40, the pedestal portions 16 are too soft, resulting, in some cases, in a rather poor depression feel when effecting switch input. On the other hand, when the hardness exceeds type A80, the flexible portions 18 are not easily deformed, and the requisite depression load for switch input may be rather large.

To manufacture the base sheet 12 as described above, the hard resin plate 14 is first obtained by a molding process, such as injection molding. Then, the hard resin plate 14 is transferred into the cavity of a mold for injection molding for thermoplastic elastomer, and thermoplastic elastomer is injected. In this way, the base sheet 12 with the integrally molded pedestal portion 16 is obtained. Apart from this manufacturing method, two-color molding may also be employed; when the pedestal portions 16 are formed of silicone rubber or the like, it is also possible to mold-press-fit silicone rubber to the hard resin plate 14 by using a mold. After the preparation of the base sheet 12, the predetermined keytops 13 obtained by injection molding, extrusion molding or the like are attached to the respective pedestal portions 16, whereby the key sheet 11 of this embodiment of the present invention is obtained.

Other Embodiments

The base sheet 12 for use in a pushbutton switch in which the keytops 13 arranged close to each other are exposed through an operational opening 101*b* with no partition frame allows various modifications in configuration, which will be described below. Regarding the base sheet, there are two cases: a case in which the frame-like support portion supporting the pedestal portions so as to allow displacement thereof consists of a reinforcing member in the form of a thin hard resin plate, and a case in which the frame-like support portion consists of a resin film having through-holes for fixing the pedestal portions through bridging. These two cases will be described below one by one.

Figure 6:
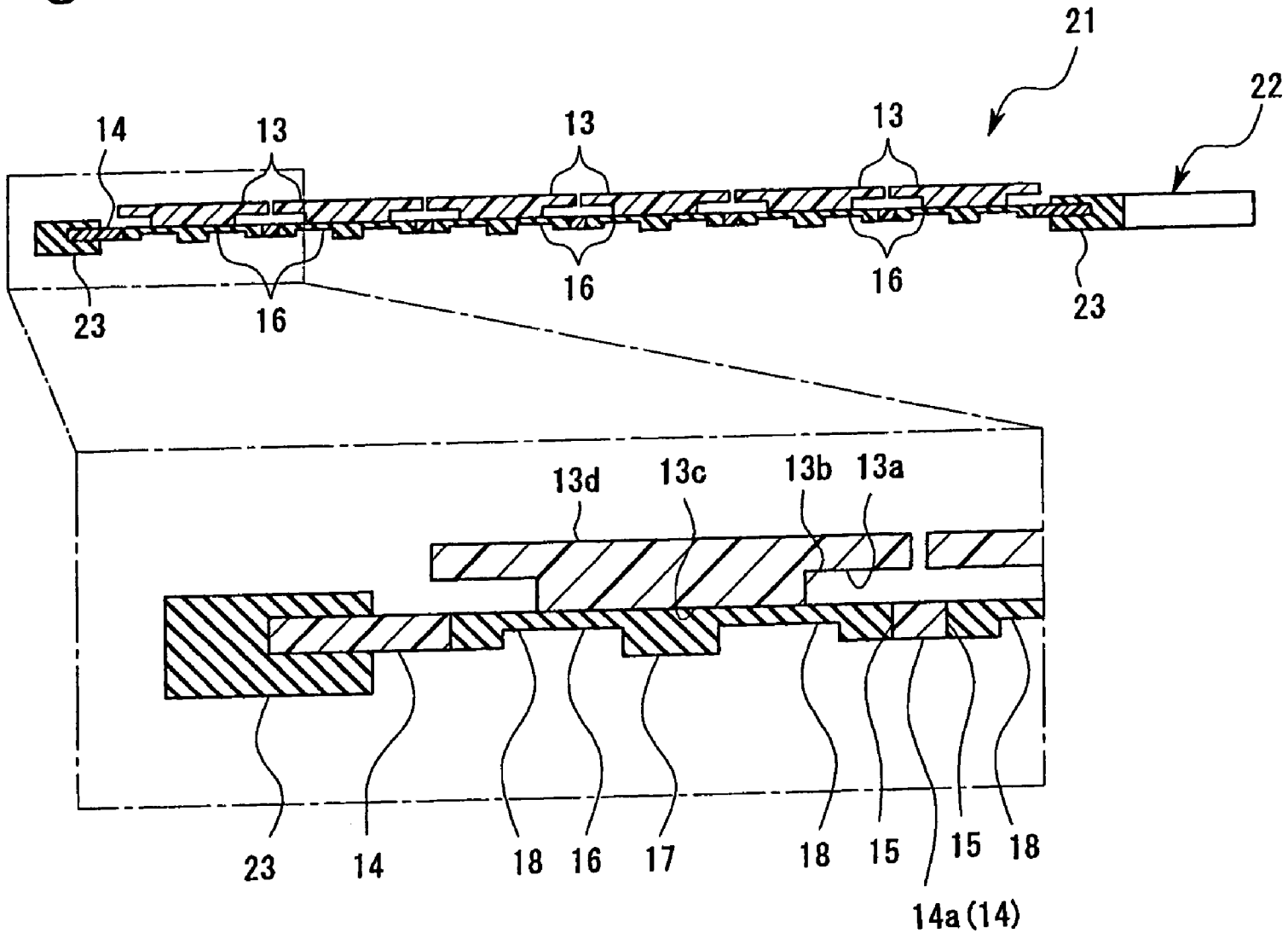
FIG. 6 is a sectional view, similar to FIG. 2, of a key sheet according to a second embodiment of the present invention.

(A.) The Case in which the Frame-like Support Portion is a Reinforcing Member in the Form of a Thin Hard Resin Plate;

Second Embodiment Shown in FIG. 6;

FIG. 6 is a sectional view of a key sheet 21 according to a second embodiment of the present invention. In the key sheet 21, the hard resin plate 14 of a base sheet 22 is integrally molded with a reinforcing outer frame 23 constructed of silicone rubber, thermoplastic elastomer and serving as a reinforcing member and a press contact receiving portion. By thus forming the reinforcing outer frame 23 covering the outer edge of the hard resin plate 14, the overall rigidity of the base sheet 21 is further improved as compared with the first embodiment of the present invention. Further, the reinforcing outer frame 23 formed of silicone rubber, thermoplastic elastomer or the like is superior in configuration conformability with respect to the surface to which press contact is effected when it is held through press contact by the opening edge side portion of the operational opening 101*b* in the back surface 101*c* of the casing 101*a* of the mobile phone 101 and the circuit board 101*d* contained in the casing 101*a*. Thus, a strong retaining force is exerted, and it is also possible to obtain a superior sealing property with respect to liquid, dust, etc. that would otherwise enter the casing 101*a* through the operational opening 101*b*.

Also with the base sheet 22 having this reinforcing outer frame 23, there is provided, in the outer periphery of the bottom portion of each keytop 13 opposed to the frame portion 14*a*, a clearance portion 13*a* for avoiding press contact with the frame portion 14*a* at the time of depressing operation. Thus, even when the keytop 13 is depressed, the keytop 13 is not caught by the frame portion 14*a* constituting the frame-like support portion, and it is possible to obtain a sufficient depression stroke for the keytop 13.

Figure 7:
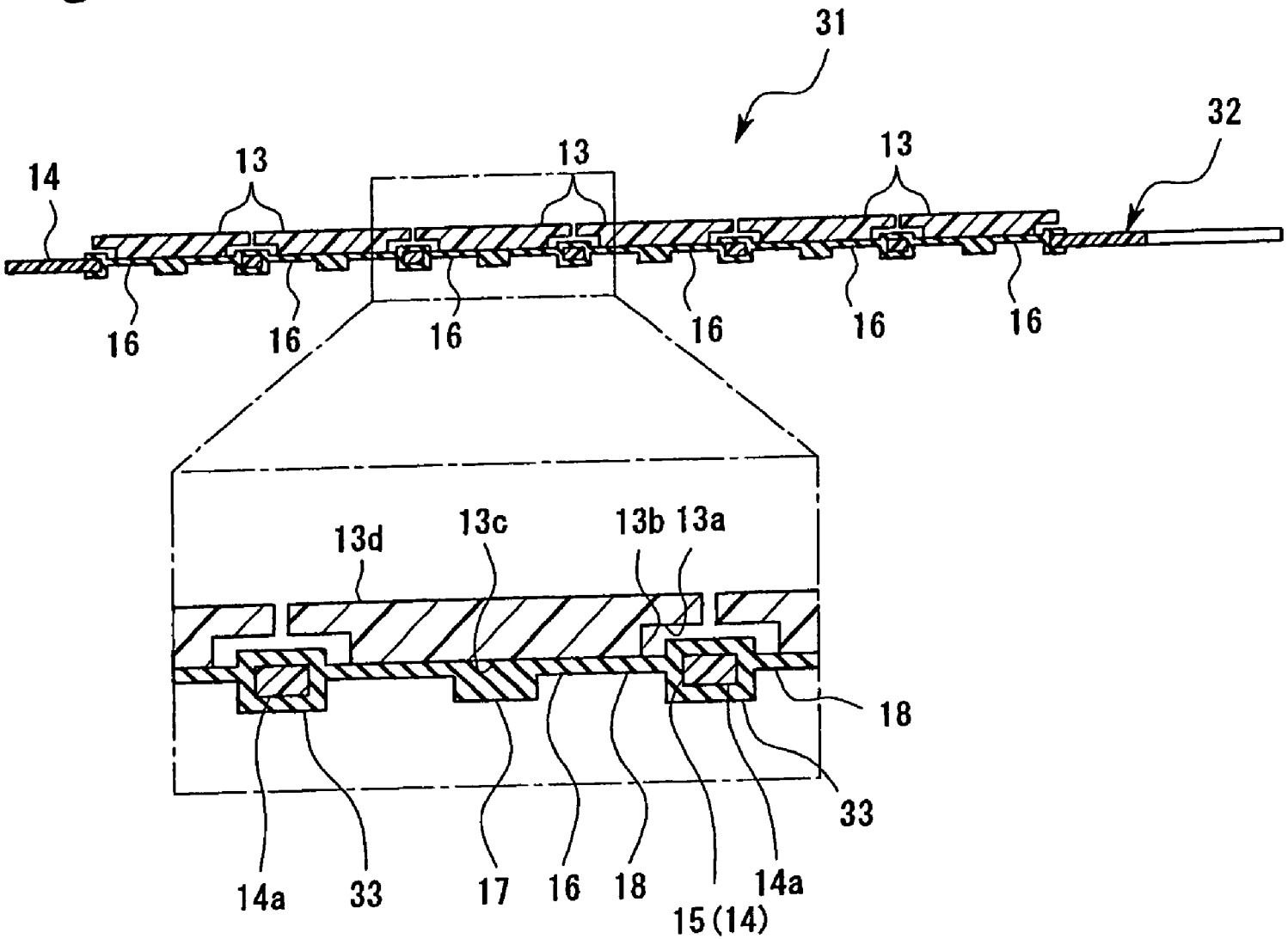
FIG. 7 is a sectional view, similar to FIG. 2, of a key sheet according to a third embodiment of the present invention.

Third Embodiment Shown in FIG. 7

FIG. 7 is a sectional view of a key sheet 31 according to a third embodiment of the present invention. In a base sheet 32 of the key sheet 31, reinforcing layers 33 as reinforcing members constructed of a silicone rubber, a thermoplastic elastomer or the like integrally molded with the pedestal portions 16, are formed on the obverse and reverse sides of the frame portions 14*a* of the hard resin plate 14 as the frame-like support portion separating the through-holes 15 from each other. Due to these reinforcing layers 33, an enhancement in rigidity is achieved while protecting the narrow and thin frame portions 14*a* from damage, rupture or the like, and the overall rigidity of the base sheet 32 is improved as compared with the first embodiment of the present invention, making it possible to more reliably restrain generation of distortion in the key sheet 31.

In this embodiment of the present invention, the frame portions 14*a* are surrounded by the reinforcing layers 33, so that the reinforcing layers 33 are swollen toward the keytops 13 side as compared with the upper surfaces of the pedestal portions 16. However, since the clearance portions 13*a* are formed higher than the swellings of the reinforcing layers 33, there is no fear of the keytops 13 abutting the frame-like support portion having the frame portions 14*a* surrounded by the reinforcing layers 33 even when the keytops 13 are depressed. Thus, in the key sheet 31 of this embodiment of the present invention, it is possible to attain a sufficient depression stroke for the keytops 13 while enhancing the rigidity of the key sheet as a whole.

Figure 8:
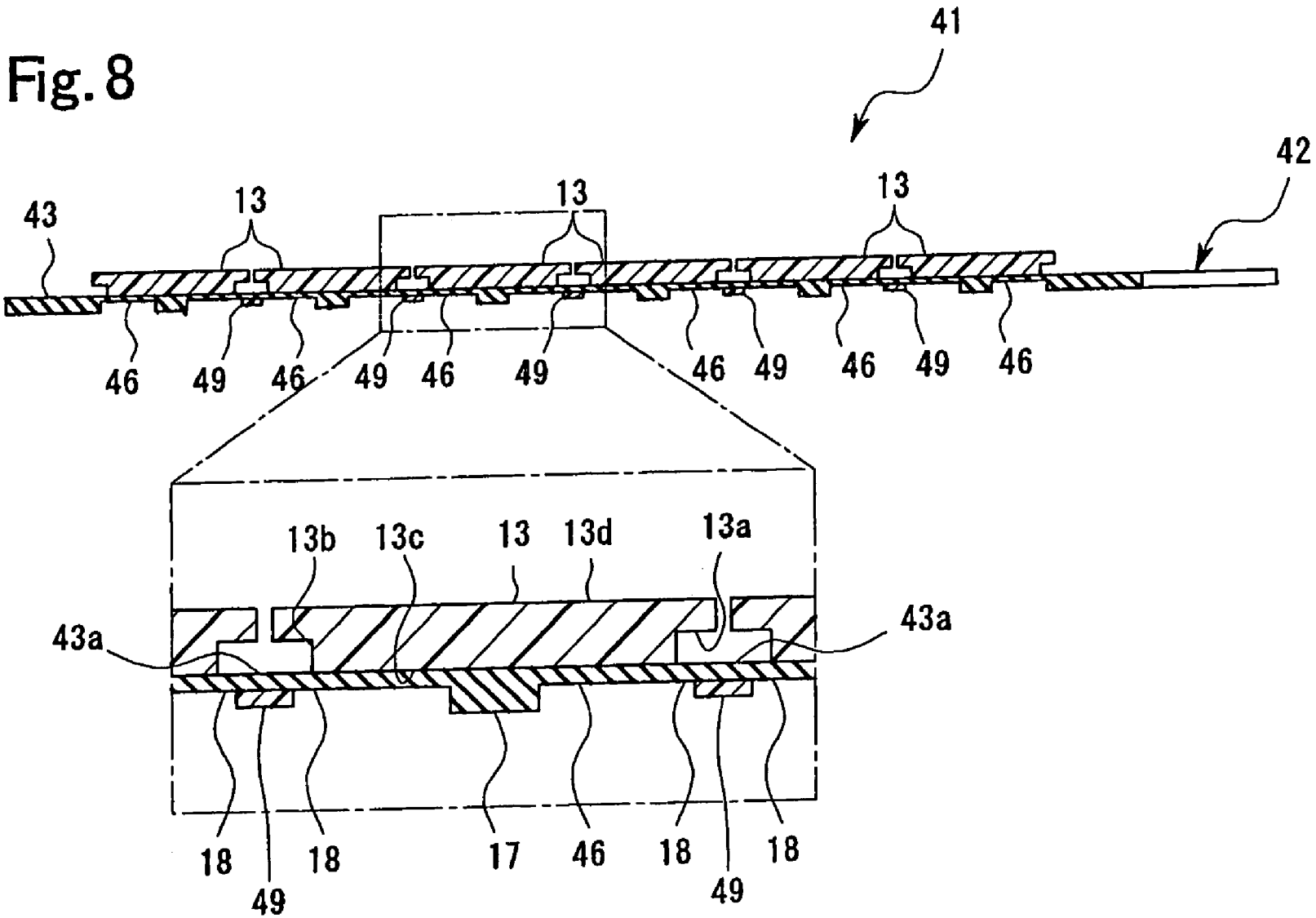
FIG. 8 is a sectional view, similar to FIG. 2, of a key sheet according to a fourth embodiment of the present invention, taken along the line VIII—VIII of FIG. 17.
Figure 17:
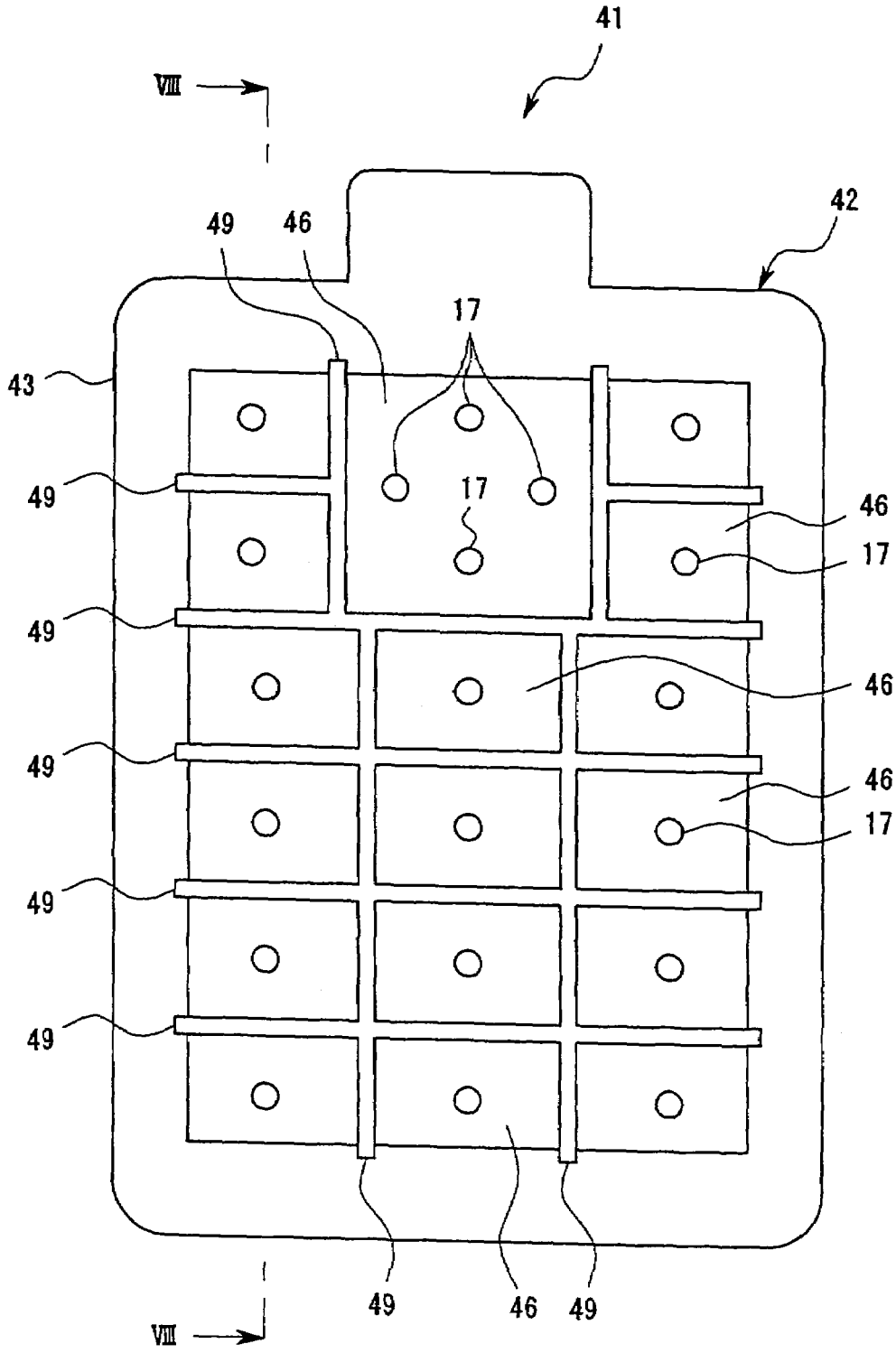
FIG. 17 is a top plan view of the back surface of a key sheet according to a fourth embodiment of the present invention.
Figure 18:
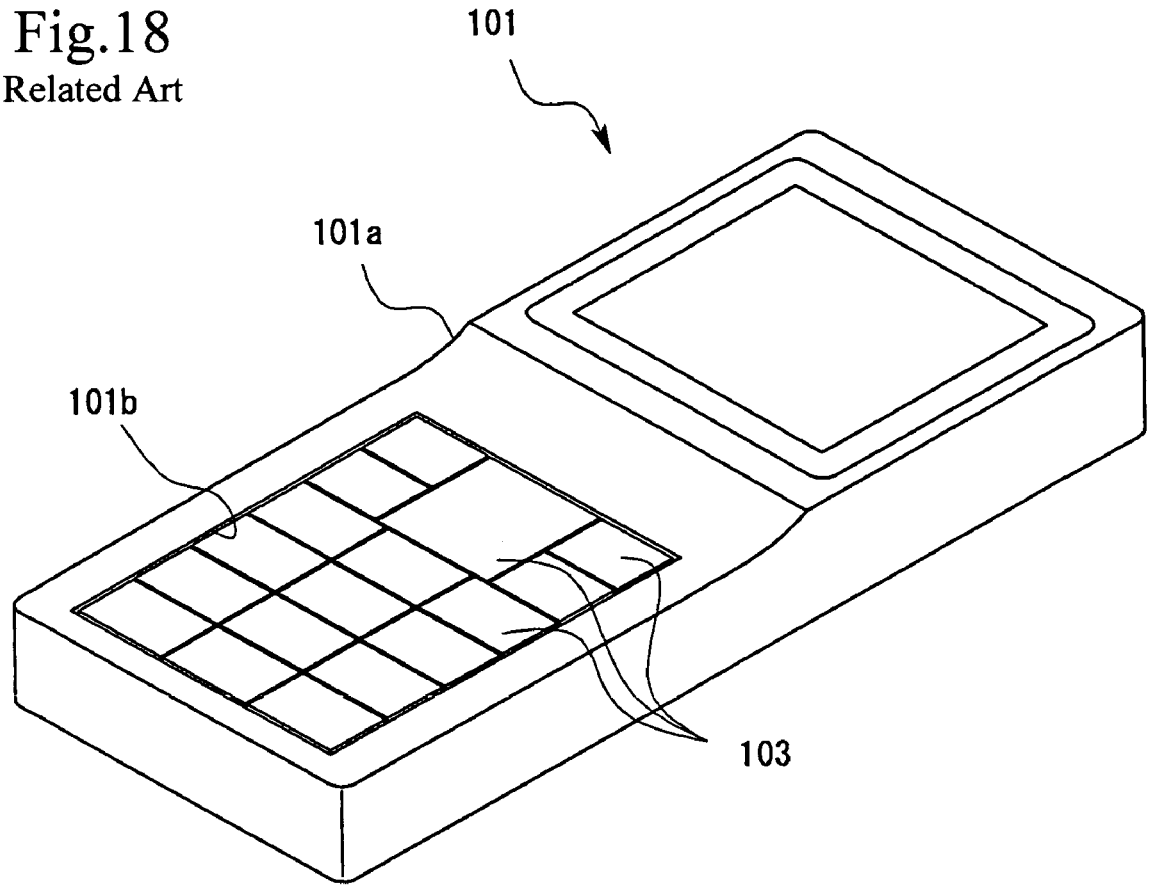
Fig.18 Related Art
FIG. 18 is a perspective view of a mobile phone.
Figure 19:
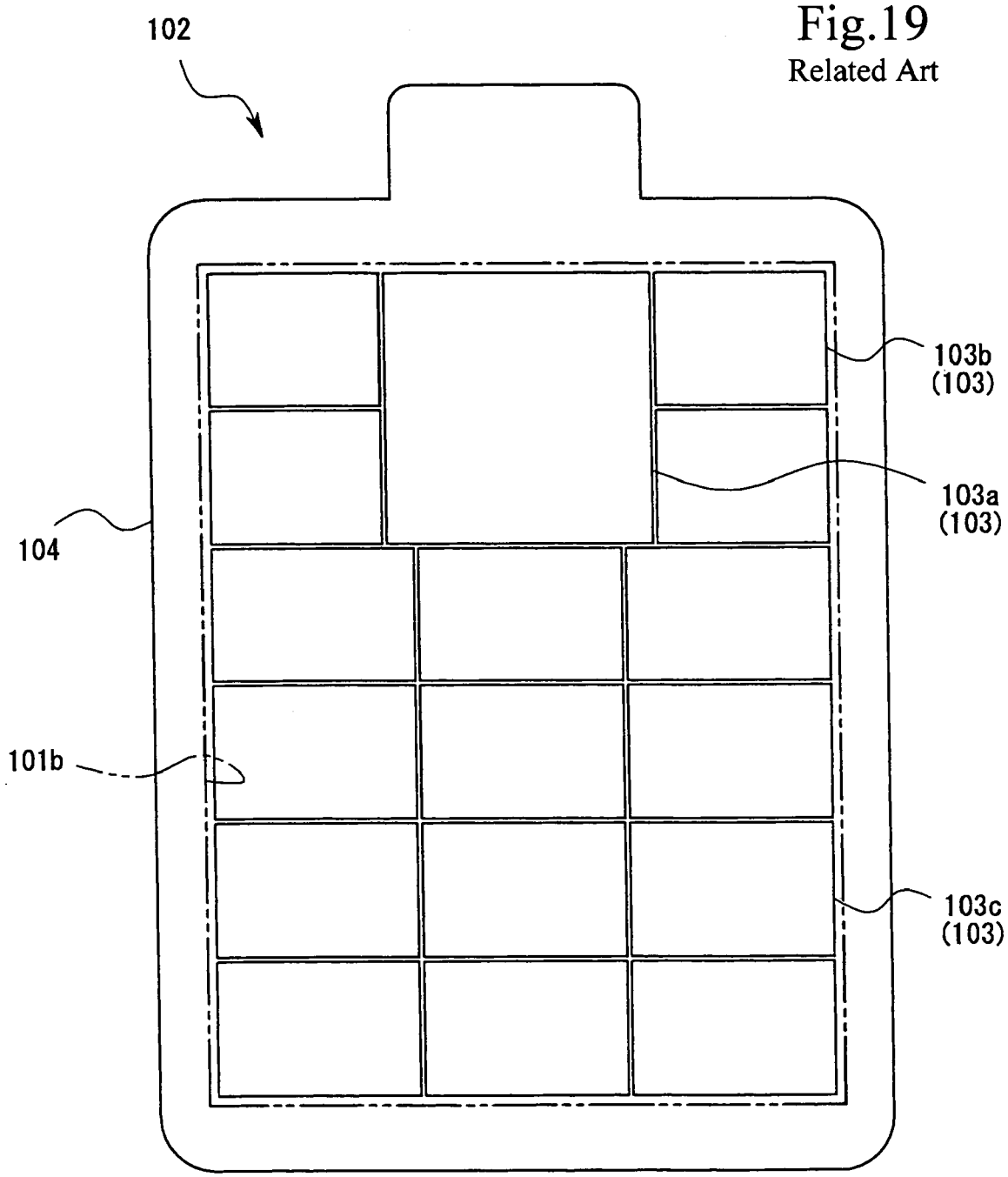
Fig.19 Related Art
FIG. 19 is a top plan view of a conventional key sheet with which the mobile phone of FIG. 18 is to be equipped.
Figure 20:
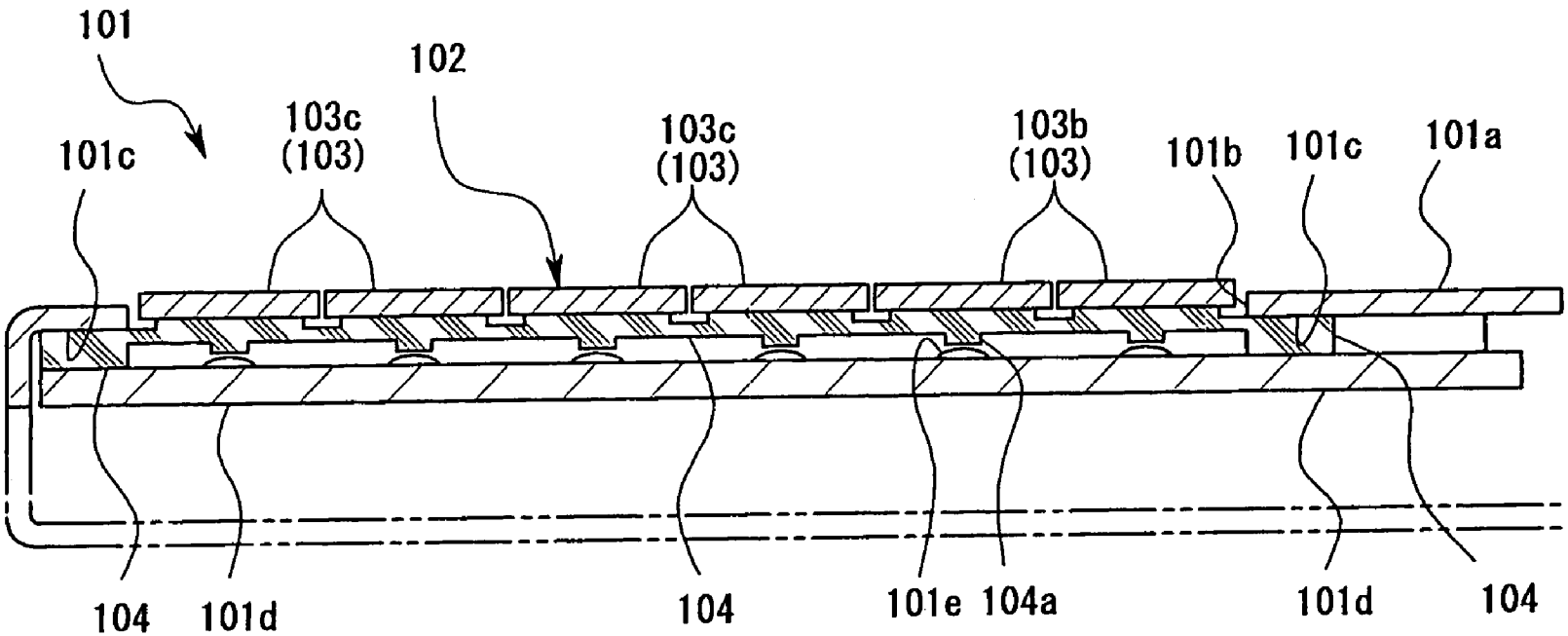
Fig.20 Related Art
FIG. 20 is a schematic sectional view of a conventional key sheet as attached to a mobile phone.
Figure 21:
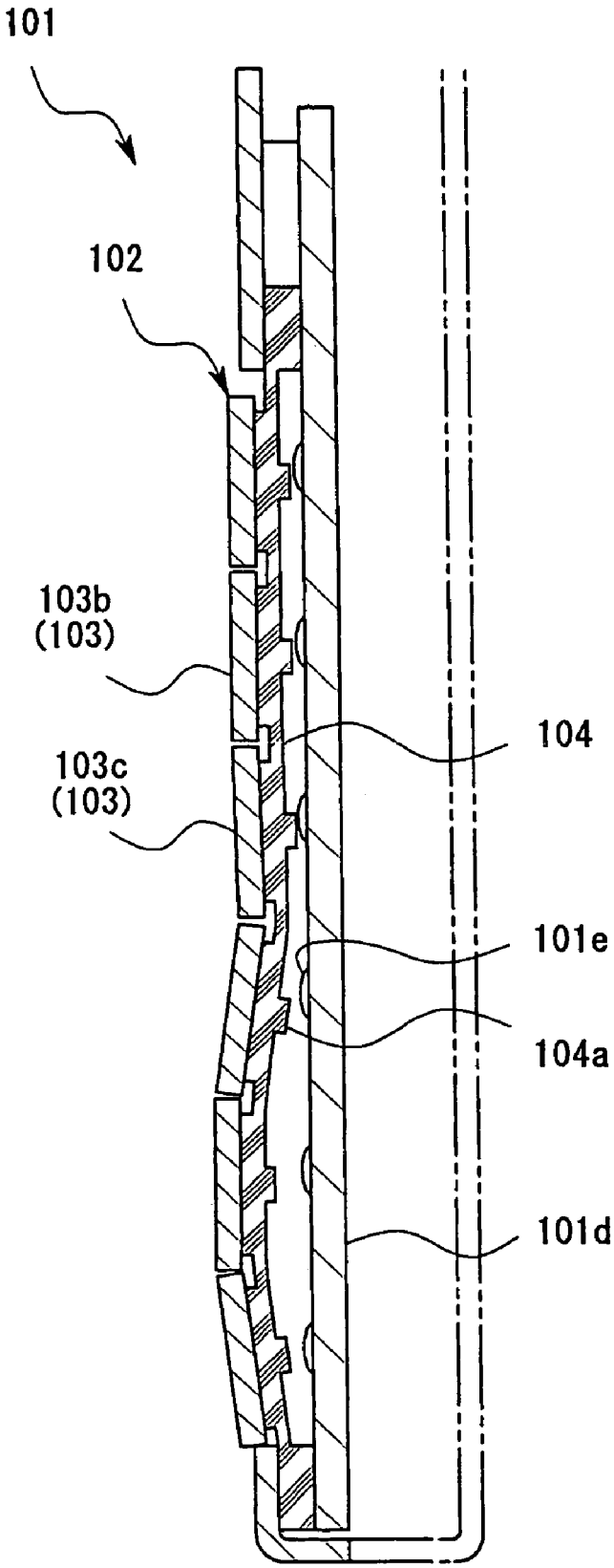
Fig.21 Related Art
FIG. 21 is a schematic sectional view showing the mobile phone equipped with the conventional key sheet of FIG. 20 in an erect state.
Figure 22:
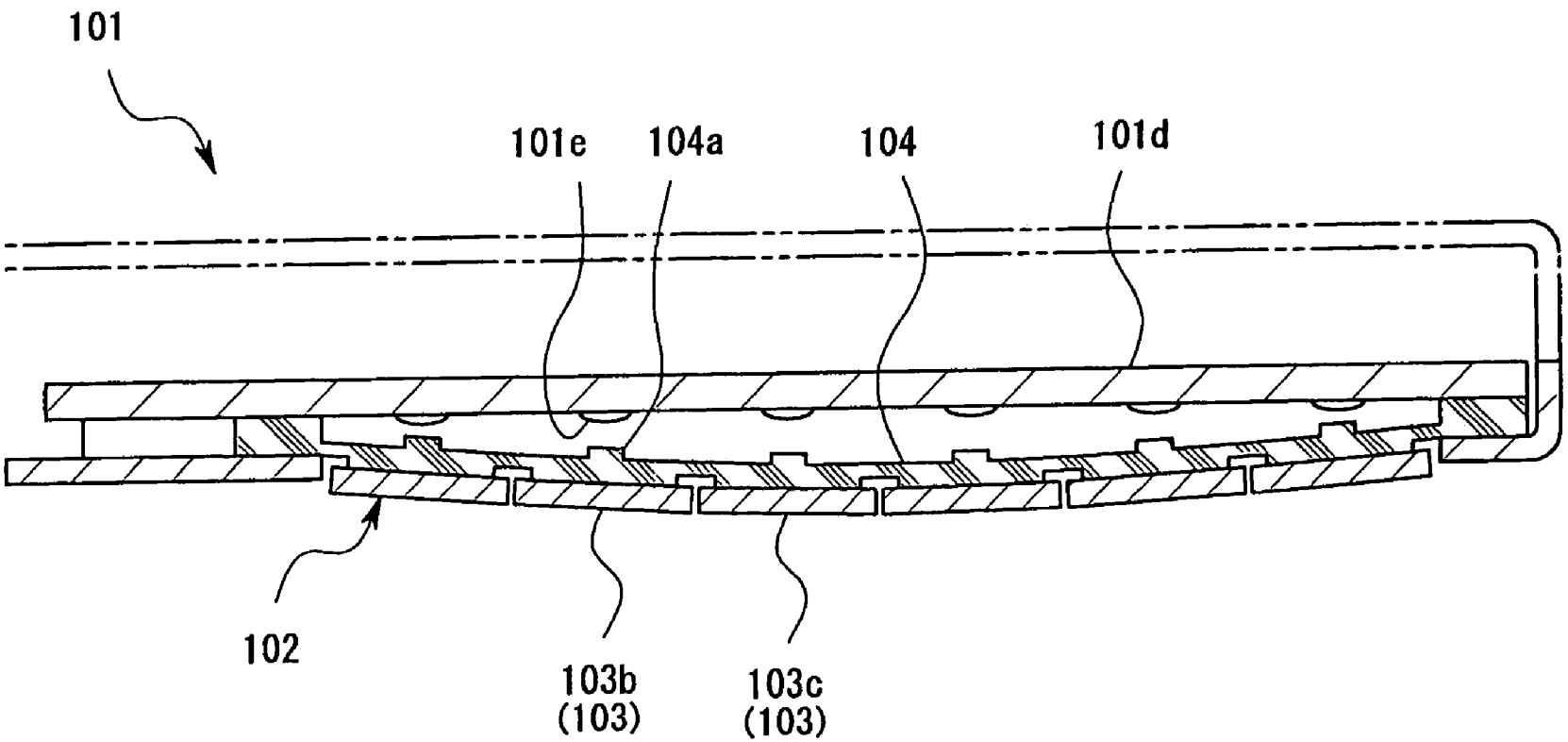
Fig.22 Related Art
FIG. 22 is a schematic sectional view showing the mobile phone equipped with the conventional key sheet of FIG. 20 in a state in which it is laid down.
Figure 23:
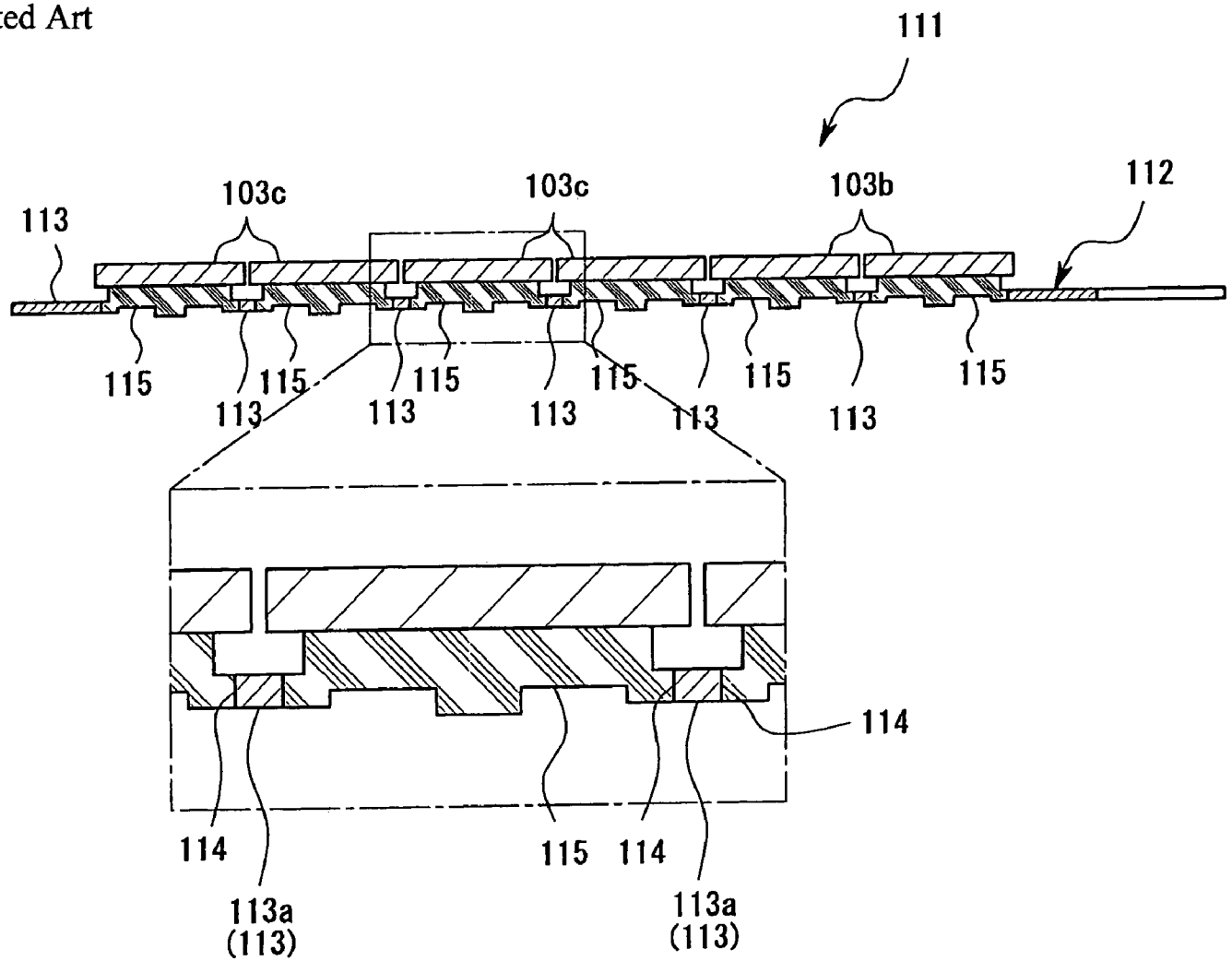
FIG. 23 is a sectional view, similar to FIG. 2, showing another conventional key sheet.

Fourth Embodiment Shown in FIG. 8 and FIG. 17

FIG. 8 is a sectional view of a key sheet 41 according to a fourth embodiment of the present invention. The key sheet 41 differs from those of the above embodiments of the present invention in that an entire base sheet 42 consists of an elastic sheet 43 formed of silicone rubber, thermoplastic elastomer or the like as a rubber-like elastic material. And, firmly attached to the back side of frame portions 43*a* separating pedestal portions 46 formed in the elastic sheet 43 from each other, is a reinforcing inner frame 49 as a frame-like support portion formed by a hard resin molding in the form of a thin plate. Thus, in this embodiment, the rigidity in the frame portions 43*a* is improved by the reinforcing inner frame 49, with the result that the rigidity of the base sheet 42 as a whole is improved, making it possible to more reliably restrain generation of distortion in the key sheet 41.

In this embodiment also, there is formed a clearance portion 13*a* for avoiding press contact with the reinforcing inner frame 49 at the time of depressing operation in the outer periphery of the bottom portion of each keytop 13 opposed to the reinforcing inner frame 49 as the frame-like support portion, so that when the keytop 13 is depressed, there is no fear of the keytop 13 being caught by the reinforcing inner frame 49, making it possible to perform depressing operation on the keytop 13 in a satisfactory manner.

To produce the base sheet 42 of the fourth embodiment of the present invention, the reinforcing inner frame 49 is first prepared by molding such as injection molding. Then, the reinforcing inner frame 49 is transferred into the cavity of an injection molding mold for thermoplastic elastomer, and the pedestal portions 46 are formed by injection molding, whereby the base sheet 42 is obtained. Apart from this manufacturing method, it is also possible to adopt two-color molding or the like; when, for example, the pedestal portions 46 are formed of silicone rubber or the like, silicone rubber may be molding-press-fitted to the hard resin plate 14 by using a mold, or the reinforcing inner frame 49 may be bonded, by adhesive, to the pedestal portions 46 molded beforehand. Further, in a modification, a liquid UV setting type resin, for example, is applied in correspondence with the reinforcing inner frame 49, thereby forming a further reinforcing layer corresponding to the reinforcing inner frame 49. After the preparation of the base sheet 42, the predetermined keytops 13 are bonded to the respective pedestal portions 46, whereby the key sheet 41 of this embodiment of the present invention is obtained.

Figure 9:
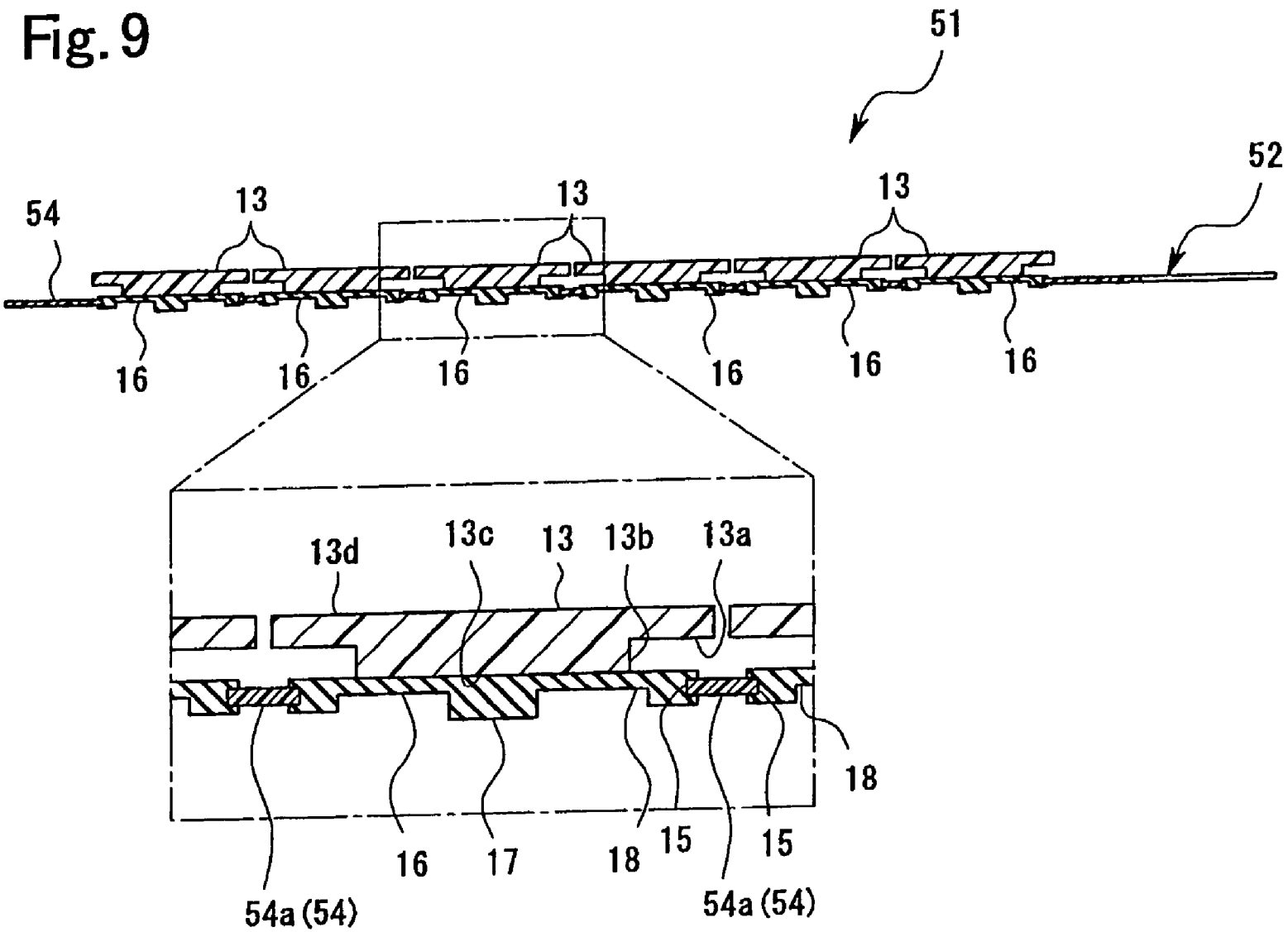
FIG. 9 is a sectional view, similar to FIG. 2, of a key sheet according to a fifth embodiment of the present invention.

(B.) The Case in which a Resin Film having a Frame-like Support Portion is Employed;

Fifth Embodiment Shown in FIG. 9

FIG. 9 is a sectional view of a key sheet 51 according to a fifth embodiment of the present invention. This embodiment differs from the first embodiment in that, instead of the hard resin 14 used in the first embodiment, a base sheet 52 is equipped with a single resin film 54 as the base body. As the resin film 54, there is used a hard resin film with rigidity capable of restraining generation of overall distortion of the key sheet 51 even when it is erected or laid down in a state in which the plurality of keytops 13 supported by the pedestal portions 16 are exposed through the operational opening 101*b* with no partition frame formed in the casing 101*a* of the mobile phone 101. Examples of the material of the film that can be used include polycarbonate, polyethylene terephthalate, nylon, vinyl chloride, polyamide, and polyimide, and an alloy film belonging thereto. Specific examples of the material of the resin film 54 that can be used include lupilon (registered trademark) film (manufactured by Mitsubishi Gas Chemical Company, Inc.), and Panlite (registered trademark) sheet (manufactured by Teijin Chemicals Ltd.).

To manufacture the base sheet 52 as described above, the through-holes 15 are formed in the resin film 54 by a trimming die or the like, and then the film is transferred to a mold for injection molding. Then, thermoplastic elastomer is injected into the cavity for molding the pedestal portions 16, and curing treatment is conducted. When the pedestal portions 16 are integrally molded in the through-holes 15, the base sheet 52 is obtained. Apart from this manufacturing method, it is also possible to adopt two-color molding; when the pedestal portions 16 are formed of silicone rubber or the like, it is possible to mold-press-fit silicone rubber to the resin film 54 by using a mold. Thereafter, the predetermined keytops 13 are bonded to the pedestal portions 16, whereby the key sheet 51 of this embodiment of the present invention is obtained.

In this embodiment also, there is provided, in the outer periphery of the bottom portion of each keytop 13 opposed to the frame portion 54*a*, a clearance portion 13*a* for avoiding press contact with the frame portion 54*a* at the time of depressing operation. Thus, if the keytop 13 is depressed the keytop 13 is not caught by the frame portion 54*a* forming the frame-like support portion, and it is possible to obtain a sufficient depression stroke for the keytop 13.

Figure 10:
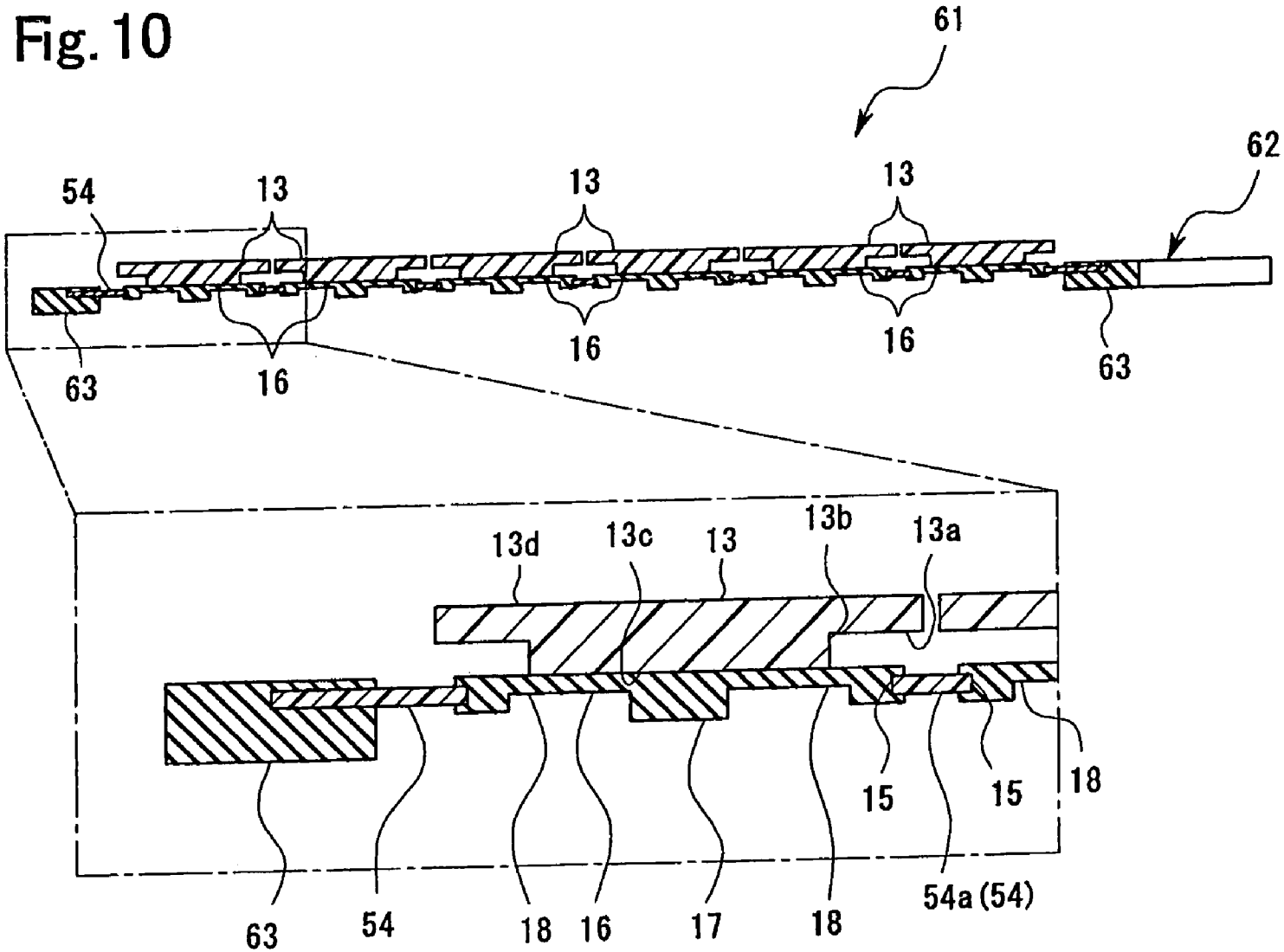
FIG. 10 is a sectional view, similar to FIG. 2, of a key sheet according to a sixth embodiment of the present invention.

Sixth Embodiment Shown in FIG. 10

FIG. 10 is a sectional view of a key sheet 61 according to a sixth embodiment of the present invention. As in the second embodiment, in this embodiment, a reinforcing outer frame 63 formed of silicone rubber, thermoplastic elastomer or the like is integrally formed on the resin film 54 of a base sheet 62. By thus forming the reinforcing outer frame 63 covering the outer edge of the resin film 54, the overall rigidity of the base sheet 62 is further improved as compared with the fifth embodiment of the present invention. Further, the reinforcing outer frame 63 formed of silicone rubber, thermoplastic elastomer or the like is superior in configuration conformability with respect to the surface to which press contact is effected when it is held through press contact by the opening edge side portion of the operational opening 101*b* in the back surface 101*c* of the casing 101*a* of the mobile phone 101 and the circuit board 101*d* contained in the casing 101*a*. Thus, it is also possible to obtain a superior sealing property with respect to liquid, dust, etc. which would otherwise enter the casing 101*a* through the operational opening 101*b*, and it is also possible to exert a strong retaining force.

Also in this base sheet 62 having the reinforcing outer frame 63, there is provided, in the outer periphery of the bottom portion of each keytop 13 opposed to the frame portion 54*a*, a clearance portion 13*a* for avoiding press contact with the frame portion 54*a* at the time of depressing operation. Thus, if the keytop 13 is depressed, the keytop 13 is not caught by the frame portion 54*a* constituting the frame-like support portion, making it possible to obtain a sufficient depression stroke for the keytop 13.

Figure 11:
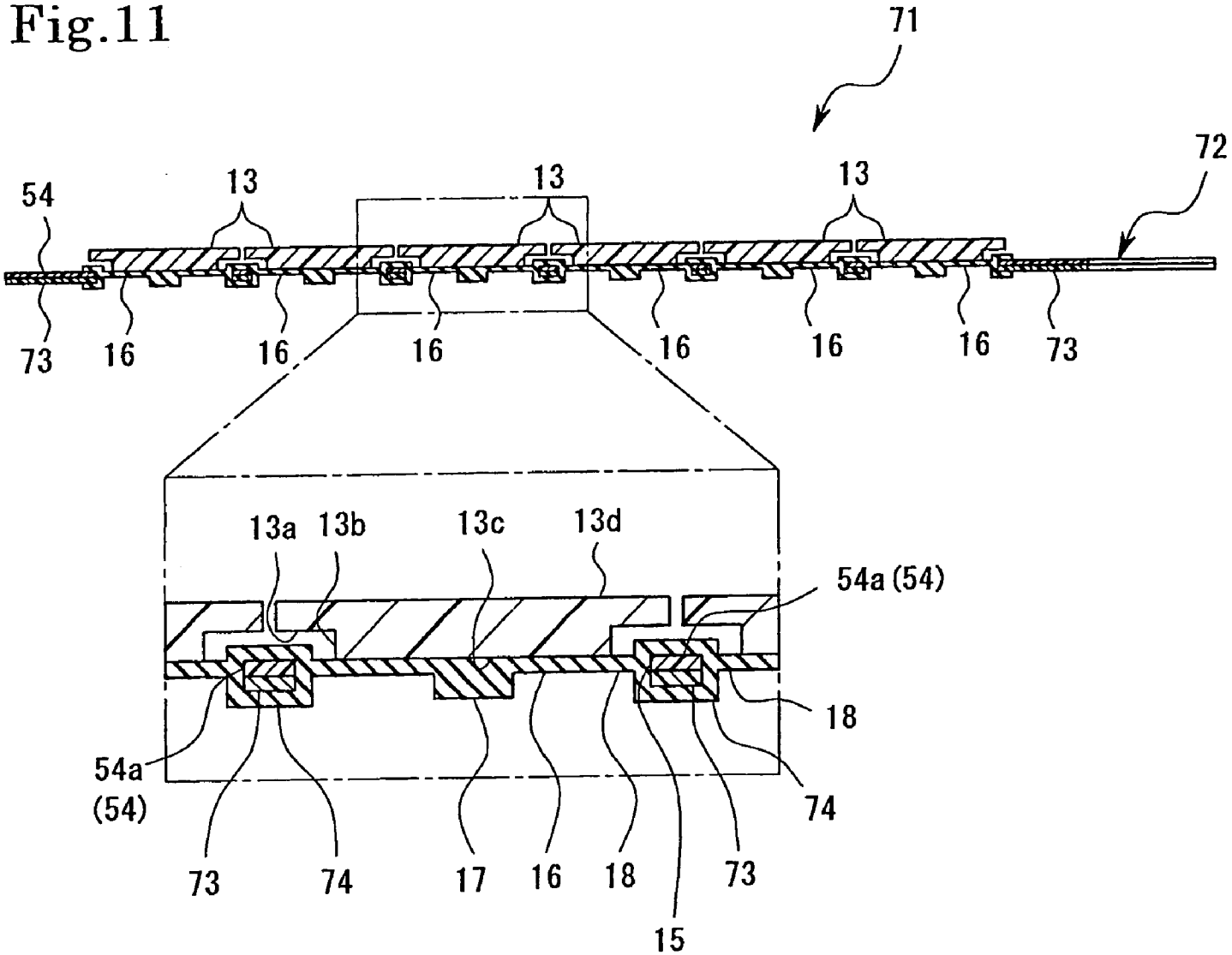
FIG. 11 is a sectional view, similar to FIG. 2, of a key sheet according to a seventh embodiment of the present invention.

Seventh Embodiment Shown in FIG. 11

FIG. 11 is a sectional view of a key sheet 71 according to a seventh embodiment of the present invention. In the key sheet 71, there is formed, on the entire back surface of the resin film 54 constituting a base sheet 72, a reinforcing layer 73 as a cured body obtained by applying and curing liquid resin. Further, on the obverse and reverse sides of the frame portions 54*a* of the resin film 54 separating the through-holes 15 from each other, there are formed reinforcing layers 74 integrally molded with the pedestal portions 16 and constructed of silicone rubber, thermoplastic elastomer or the like. In this way, in this embodiment, the entire resin film 54 is reinforced by the reinforcing layer 73, and the thin and narrow frame portions 54*a* are further reinforced by the reinforcing layer 74, whereby the overall rigidity of the base sheet 72 is enhanced, and it is possible to more reliably restrain generation of distortion of the key sheet 71.

The reinforcing layer 73 may be formed of a reaction curing based resin, such as a thermosetting resin, a photo setting resin, a humidity setting resin, or a pressure/humidity setting resin, or a non-reaction curing based resin, such as a thermoplastic resin. In particular, the reaction curing based resin, such as the pressure/humidity setting resin or the photo setting resin, is preferable since it can be quickly cured at low temperature, and helps to enhance production efficiency. Further, it is also preferable in that the reaction curing based resin requires no heating and allows use of a film with low softening point and low heat resistance as the resin film 54, making it possible to enlarge the width of range for material selection. And, due to the reinforcement provided by the reinforcing layers 73 and 74, the resin film 54 of this embodiment may be one with lower rigidity and hardness than those of the above embodiments.

In this embodiment, the resin film 54 is reinforced by the reinforcing layer 73, and is further surrounded by the reinforcing layers 74, so that the frame portions 54*a* surrounded by the reinforcing layers 74 are swollen toward the keytops 13 side than the upper surfaces of the pedestal portions 16. However, the clearance portions 13*a* are formed higher than the swellings of the reinforcing layers 74, so that if the keytops 13 are depressed, the keytops 13 do not hit the frame portions 54*a*, which are the frame-like support portions surrounded by the reinforcing layers 74. Thus, in the key sheet 71 of this embodiment, it is possible to achieve a sufficient depression stroke for the keytops 13 while enhancing the rigidity of the key sheet as a whole.

Figure 12:
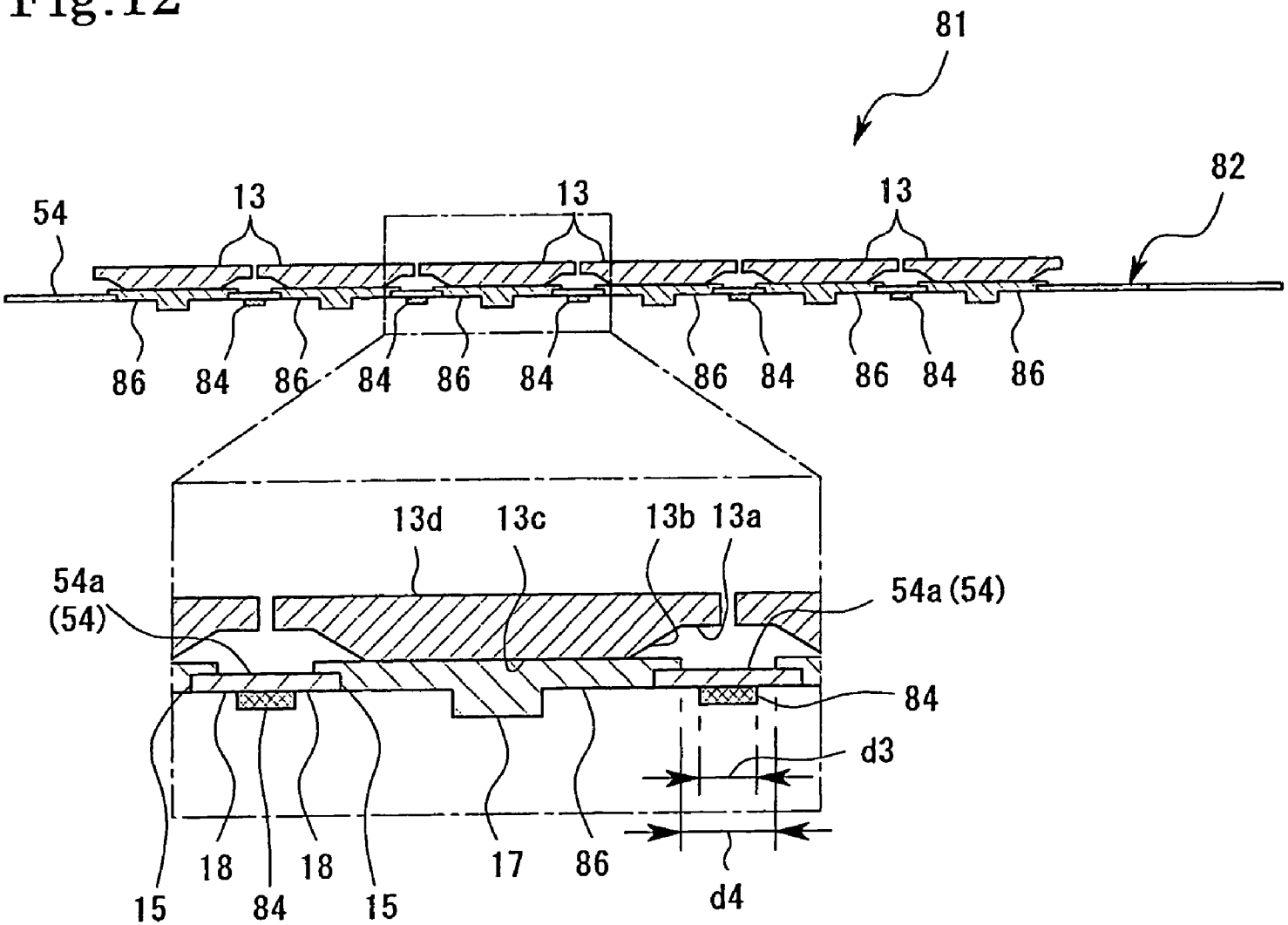
FIG. 12 is a sectional view, similar to FIG. 2, of a key sheet according to an eighth embodiment of the present invention.

Eighth Embodiment Shown in FIG. 12

FIG. 12 is a sectional view of a key sheet 81 according to a eighth embodiment of the present invention. The key sheet 81 differs from those of the above-described embodiments 1 through 7 in that it has a base sheet 82 with pedestal portions 86 formed of hard resin. The pedestal portions 86 can be formed integrally with the resin film 54 by a method similar to that of the fifth embodiment, that is, injection molding. Further, in the base sheet 82 of this embodiment, a reinforcing inner frame 84 constructed of a hard resin molding in the form of a thin plate is firmly attached by adhesive to the back surfaces of the frame portions 54*a* constructed of the resin film 54 separating the through-holes 15 from each other. Thus, in this embodiment, the rigidity in the frame portions 54*a* is improved by the reinforcing inner frame 84, with the result that the overall rigidity of the base sheet 82 is improved, making it possible to more reliably restrain generation of distortion in the key sheet 81. And, as shown in FIG. 12, the width d3 of the reinforcing inner frame 84 is smaller than the distance d4 between the pedestal portions 86, whereby the flexible portions 18 floatingly supporting the pedestal portions 86 are formed in the frame portions 54*a*.

In this base sheet 82, there is provided, in the outer periphery of the bottom portion of each keytop 13 opposed to the frame portion 54*a*, a clearance portion 13*a* for avoiding press contact with the frame portion 54*a* at the time of depressing operation. Thus, if the keytop 13 is depressed, the keytop 13 is not caught by the reinforcing inner frame 84 that is the frame-like support portion, making it possible to perform depressing operation on the keytop 13.

In this way, the frame portion 54*a* is partially utilized as the flexible portion 18, and reinforcement is provided by the reinforcing inner frame 84, with the result that the resin film 54 of this embodiment is a softer one with lower rigidity as compared with those of the above embodiments. For example, it is possible to use Diamiron (registered trademark) C (manufactured by Mitsubishi Plastics. Inc.). Thus, in the key sheet 81 of this embodiment, in which a rigidity high enough not to generate overall distortion is ensured, the flexible portions 18 are soft, and it is possible to achieve a soft and satisfactory operational feel.

(C.) Modifications of the Embodiments ,some of which are shown in FIGS. 13A, 13B, 14A, and 14B The above-described embodiments of the present invention allow the following modifications.

While in the above embodiments the pedestal portions 16, 46, and 86 are rectangular in plan view, it is also possible for them to be of a circular, elliptical or some other polygonal configuration. Further, the configurations of the base sheets 12, 22, 32, 42, 52, 62, 72, and 82 may be of some other configuration than those of the above embodiments. For example, within the range of thickness required of the key sheet, the surface fixed to the keytops 13 may not be flat; it is also possible for the portions of the pedestal portions bonded to the keytops 103 to be swollen as in the case of the conventional key sheet 111.

Figure 13A:
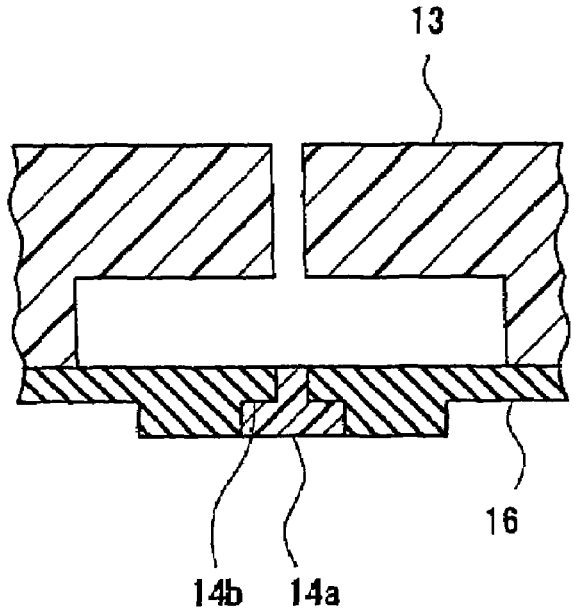
FIGS. 13A and 13B are enlarged main-portion sectional views showing modifications of the first and third embodiments of the present invention.
Figure 13B:
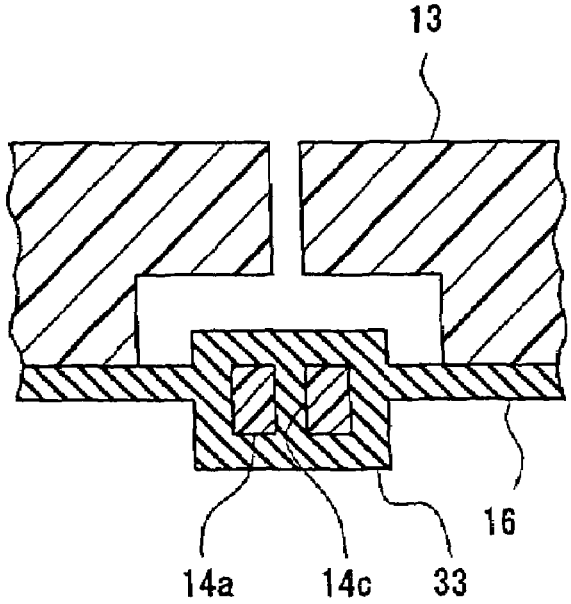

Regarding the first and second embodiments, as shown, for example, in FIG. 13A, a step portion 14*b* is formed in each frame portion 14*a*, and silicone rubber, thermoplastic elastomer or the like is firmly attached thereto, whereby the fixation area is enlarged, and it is possible to enhance the fixation force for the hard resin plate 14. Further, regarding the third embodiment, as shown in FIG. 13B, a through-hole 14*c* is formed in the frame portion 14*a*, and silicone rubber, thermoplastic elastomer or the like is poured into the same and cured, whereby the fixation area is enlarged, and it is possible to enhance the fixation force for the hard resin plate 14 due to the connection structure in which the obverse and reverse sides are connected.

While in the key sheet 41 of the fourth embodiment there is used the reinforcing inner frame 49 in the form of a single molding body corresponding to the frame portion 43*a* other than the portion of the elastic sheet 43 connected to the keytops 13, it is also possible to divide it into a plurality of molding bodies or adopt a structure in which the frame portion 43*a* is not reinforced partially. Further, inclusive of the reinforcing outer frame 23 of the second embodiment, it is possible to form it as a single molding body.

Regarding the key sheets 51 and 61 of the fifth and sixth embodiments, it is possible to form the pedestal portions 16 of hard resin as in the case of the pedestal portions 86 of the eighth embodiment.

Figure 14A:
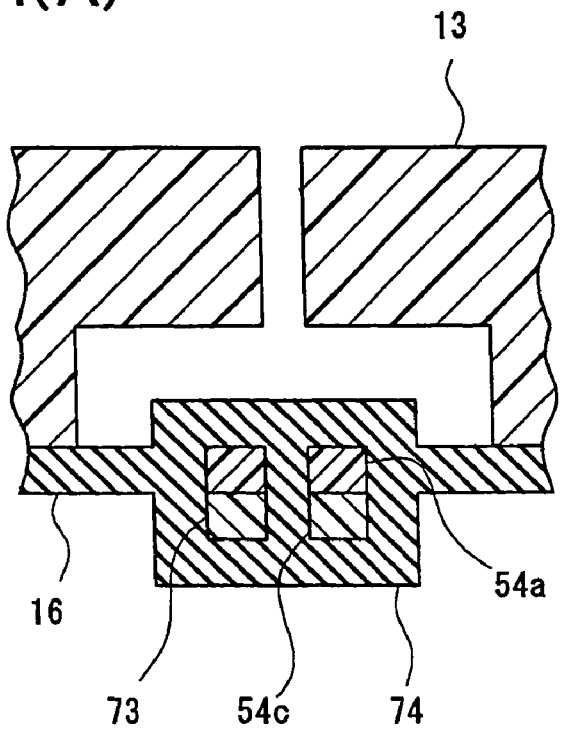
FIGS. 14A and 14B are enlarged main-portion sectional views showing modifications of the seventh and eighth embodiments of the present invention.
Figure 14B:
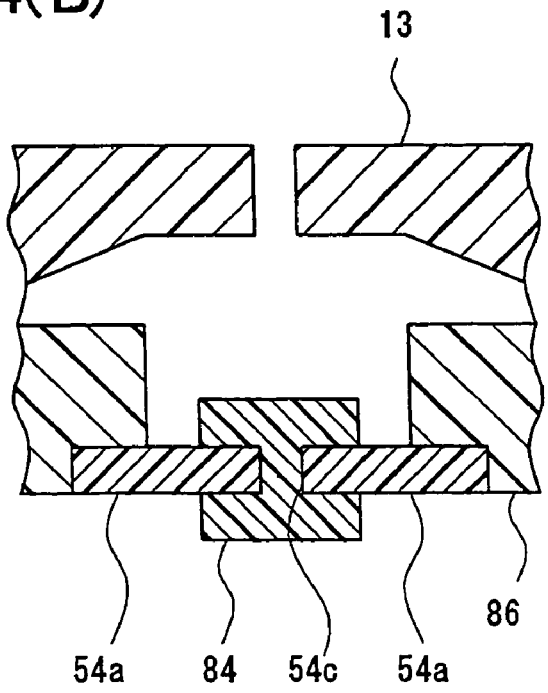

Further, regarding the seventh embodiment, it is possible, as shown, for example, in FIG. 14A, to form a through-hole 54*c* in the frame portion 54*a* and the reinforcing layer 73, and to pour silicone rubber, thermoplastic elastomer or the like into the same and cure it therein, whereby the fixation area is enlarged, and the fixation force with respect to the resin film 54 is enhanced due to the connection structure in which the obverse and reverse sides are connected. Further, in the embodiment in which the reinforcing inner frame 84 is formed by injection molding as in the eighth embodiment, it is possible, as shown, for example, in FIG. 14B, to form a through-hole 54*c* in the frame portion 54*a* and to pour molten resin into the same and cure it therein to thereby form a reinforcing inner frame 84, whereby the fixation area is enlarged, and the fixation force with respect to the resin film 54 is enhanced due to the connection structure in which the obverse and reverse sides area connected together.

While in the key sheet 81 of the eighth embodiment there is used the reinforcing inner frame 84 in the form of a single molding body in conformity with the configuration of the frame portion 54*a* of the resin film 54, it is also possible to divide it into a plurality of molding bodies, and it is also possible for the frame portion 54*a* not to be partially reinforced. Further, inclusive of the reinforcing outer frame 63 of the sixth embodiment, it is also possible to form it as a single molding body.

While in the key sheets 31 and 71 of the third and seventh embodiments there are used the reinforcing layers 33 and 74 constructed of thermoplastic elastomer and covering the obverse and reverse sides of the frame portions 14*a* and 54*a*, it is also possible for only one of the obverse and reverse sides to be covered. Further, instead of entirely covering the frame portions 14*a* and 54*a*, it is also possible for the reinforcing layers 33 and 74 to partially cover them.

Figure 15:
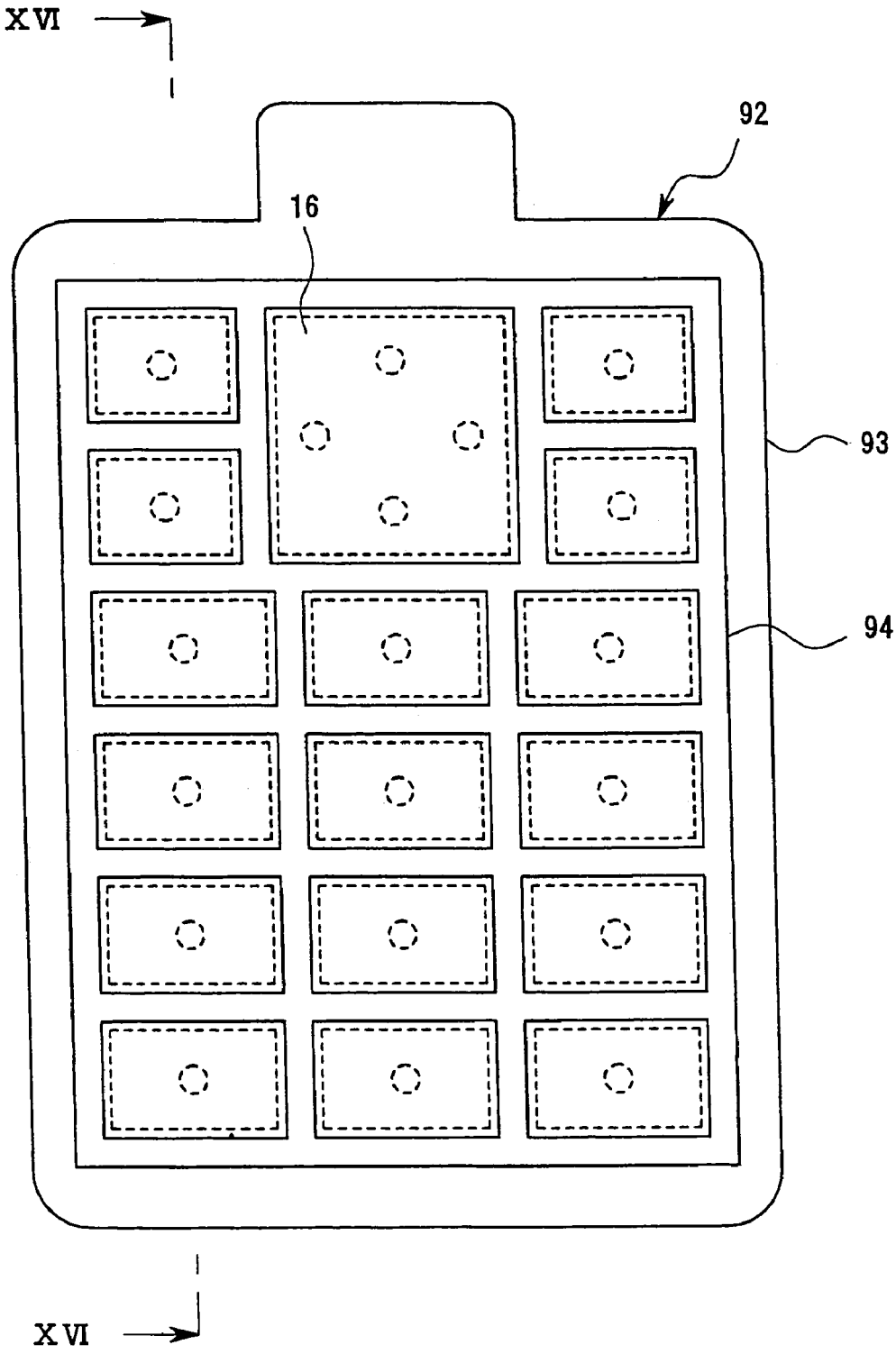
FIG. 15 is a top plan view of a surface of a base sheet, showing a modification of the third embodiment of the present invention (with no keytops shown)
Figure 16:
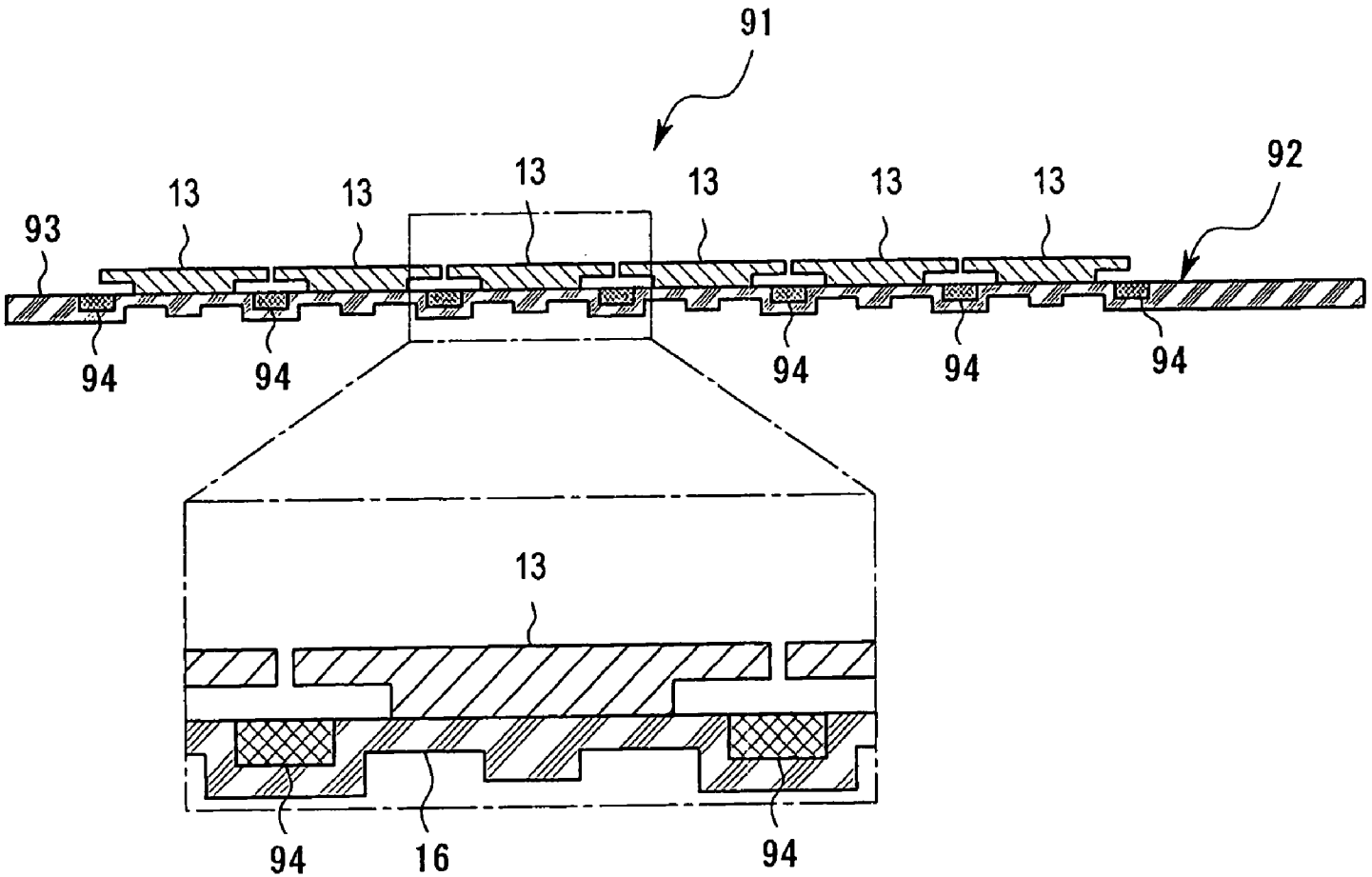
FIG. 16 is a sectional view of a portion of a key sheet corresponding to the section taken along the line XVI—XVI of FIG. 15, showing a key sheet having the base sheet of FIG. 15 with keytops attached thereto.

For example, as a modification of the third embodiment, in a key sheet 91 shown in FIG. 16, the reverse side of a reinforcing frame 94 constructed of a hard resin plate and having frame portions 94*a* is covered with an elastic sheet 93, and the obverse side thereof constitutes an exposed base sheet 92. It is to be noted that, in FIG. 15, the surface of the base sheet 92 is shown, with the keytops 13 removed from the key sheet 91.

Regarding the overall configuration of the member constituting the frame-like support member in each embodiment, it may be of a lattice-like configuration with an outer frame as in the case of the hard resin plate 14 functioning as the frame-like support portion shown in FIGS. 1 through 3 or the reinforcing frame 94 functioning as the frame-like support portion shown in FIG. 16; however, it may also be of a lattice-like configuration with no outer frame. For example, in FIG. 17, which is a bottom view of the key sheet 41 of the fourth embodiment, it is also possible to adopt an overall lattice-like configuration with no outer frame as in the case of the reinforcing inner frame 49 shown in this drawing.

In this key sheet 41, when seen from the pedestal portion 46 side, in a pedestal portion 46 situated at an end, it is supported by the reinforcing inner frame 49 at positions corresponding to the three sides thereof, and in a pedestal portion 46 situated in the middle, it is supported by the reinforcing inner frame 49 at positions corresponding to the four sides thereof. That is, each pedestal portion is not necessarily supported by the reinforcing inner frame 49 so as to leave no gap in its periphery.

While the key sheets 11, 21, 31, 41, 51, 61, 71, and 81 of the above embodiments are used in the mobile phone 101, they are also applicable to other apparatuses. The key sheets 11, 21, 31, 41, 51, 61, 71, and 81 can restrain distortion when erected or laid down during use, and help to reduce the thickness of the apparatus to which they are applied, so that they are suitable for use in a portable apparatus carried about, such as a mobile phone, PDA, or remote controller, in which the key sheet 11, 21, 31, 41, 51, 61, 71, or 81 may be erected or laid down during use.

What is claimed is:

1. A key sheet comprising a keytop exposed through an operational opening with no partition frame formed in a casing of an apparatus, the keytop being adapted to be depressed into the casing, and a base sheet to which the keytop is firmly attached, wherein the base sheet is equipped with a pedestal portion to which the keytop is firmly attached and a frame-like support portion supporting the pedestal portion so as to allow displacement of the pedestal portion, and wherein a clearance portion allowing the keytop to avoid press contact with the frame-like support portion at a time of depressing operation is formed in an outer edge side portion of a bottom portion of the keytop opposed to the frame-like support portion.

2. A key sheet according to claim 1, wherein the base sheet is provided with a plurality of the pedestal portions and a plurality of the frame-like support portions each corresponding to each the pedestal portions.

3. A key sheet according to claim 1, wherein the frame-like support portion is formed by a reinforcing member formed of a hard resin thin plate supporting the pedestal portion.

4. A key sheet according to claim 1, wherein the frame-like support portion is formed by a resin film having a through-hole for firmly attaching the pedestal portion through bridging.

5. A key sheet according to claim 4, wherein the resin film is equipped with a reinforcing member of hard resin for regulating distortion of the base sheet.

6. A key sheet according to claim 1, wherein the pedestal portion is formed of a rubber-like elastic body.

7. A key sheet according to claim 1, wherein a surface of the base sheet to which the keytop is firmly attached is flat.

8. A key sheet according to claim 1, wherein a surface of the keytop firmly attached to the base sheet has an area smaller than that of a top surface of the keytop.

9. A key sheet according to claim 1, wherein the frame-like support portion is formed of one of a hard resin material and a resin film which has a lattice-like configuration with an outer frame.

10. A key sheet according to claim 1, wherein the frame-like support portion is formed of one of a hard resin material and a resin film which has a lattice-like configuration with no outer frame.

* * * * *